US012372242B2

(12) United States Patent
Poteet

(10) Patent No.: US 12,372,242 B2
(45) Date of Patent: Jul. 29, 2025

(54) WOOD-BURNING REDUCED SMOKE INDOOR-OUTDOOR MOVEABLE FIRE PIT

(71) Applicant: Dale Alan Poteet, Crossville, TN (US)

(72) Inventor: Dale Alan Poteet, Crossville, TN (US)

( * ) Notice: Subject to any disclaimer, the term of this patent is extended or adjusted under 35 U.S.C. 154(b) by 0 days.

(21) Appl. No.: 18/663,000

(22) Filed: May 13, 2024

(65) Prior Publication Data

US 2024/0302046 A1 Sep. 12, 2024

Related U.S. Application Data

(62) Division of application No. 18/088,758, filed on Dec. 26, 2022, now Pat. No. 11,988,388.

(51) Int. Cl.
*F24B 13/02* (2006.01)
*F24B 3/00* (2006.01)

(52) U.S. Cl.
CPC ..... *F24B 3/00* (2013.01); *F24B 13/02* (2013.01)

(58) Field of Classification Search
CPC ..... F24B 3/00; F24B 13/02
USPC ..... 126/25 R
See application file for complete search history.

(56) References Cited

U.S. PATENT DOCUMENTS 1,279,033 A * 9/1918 Stollberg ..... F23G 5/42 110/259
3,331,365 A * 7/1967 Sussan ..... A47J 37/0763 126/25 R
4,448,185 A 5/1984 Buckner
4,630,593 A * 12/1986 Gremillion ..... A47J 37/0786 126/41 R
5,176,124 A 1/1993 Wrasse
5,598,834 A * 2/1997 Grady ..... F24B 1/181 126/506
6,419,103 B1 * 7/2002 Wang ..... B65D 9/32 220/641
7,766,004 B1 8/2010 Bourgeois
2010/0288263 A1 * 11/2010 Sykes ..... F24B 1/181 126/519

(Continued)

OTHER PUBLICATIONS https://patentimages.storage.googleapis.com/61/04/11/ea8d5bb0bcce48/USD258259.pdf.

(Continued)

*Primary Examiner* — Avinash A Savani
(74) *Attorney, Agent, or Firm* — Steven M. War, Esq.; War IP Law PLLC

(57) ABSTRACT

The invention describes a fire pit which includes at least three legs, a welded pipe cap base, a lower rail, a lower frame flange, a lower spark screen keeper, a reflector/spark screen, and upper spark screen keeper, an upper frame flange, an upper rail, a coil spring upper rail bumper, and a damper lid. The invention comprises an all-metal, wood-burning, reduced smoke, increased efficiency, essentially flame-contained, spark-suppressed, enhanced safety fire pit/fireplace with a metal screen enclosed vertical combustion column, dual safety rail barriers, manually moveable with incorporated two-wheel design, with grill surface, ash containment and ash removal apparatus, with various cooking implement attachment points, optionally configurable and fitted for either indoor or outdoor use, instantly extinguishable (by covering with the provided balanced handled steel safety barrel), and available with optional umbrella-picnic-table.

5 Claims, 35 Drawing Sheets

(56) References Cited

U.S. PATENT DOCUMENTS

2022/0341596 A1 10/2022 Muir

OTHER PUBLICATIONS https://patentimages.storage.googleapis.com/76/f7/3a/893a7bbc2834antial8/USD477062.pdf.
https://patents.google.com/patent/US20150285507A1/en?q=smokeless+fire+pit&oq=smokeless+fire+pit&page=1.
https://patents.google.com/patent/USD923163S1/en?oq=D923163.
https://patentimages.storage.googleapis.com/51/2d/a9/bcff6ef0232205/USD927659.pdf.

* cited by examiner

WOOD-BURNING REDUCED SMOKE INDOOR-OUTDOOR MOVEABLE FIRE PIT

CROSS-REFERENCE TO RELATED APPLICATIONS

The present application is a division of U.S. application Ser. No. 18/088,758 filed on Dec. 26, 2022, which is incorporated by reference herein in its entirety.

TECHNICAL FIELD

The present disclosure relates to a reduced smoke fire pit and more particularly to a wood-burning reduced smoke indoor-outdoor movable fire pit.

BACKGROUND OF THE INVENTION

Fire pits and fireplaces have been around for thousands of years. They are used for heating, cooking, ambience, relaxation, and enjoyment. Fire pits are popular in campgrounds, on beaches, in backyards, and on decks. Despite their popularity, some of the most annoying characteristics of having a fire in a fire pit are: (1) it is easy to get burned by the fire pit, (2) the amount of smoke that the fire pits produce, and (3) it is difficult, if not impossible, to move heavy duty, well-constructed, fire pits from one place to another.

SUMMARY OF THE INVENTION

In one embodiment of the invention, a fire pit comprises: at least three legs, a circular lower rail wherein each of the at least three legs is attached to the circular lower rail, a welded pipe cap base wherein the welded pipe cap base is attached to the lower rail, a circular upper rail wherein the circular upper rail is connected to the circular lower rail, a burner unit wherein the burner unit is located within the circular lower rail and within the circular upper rail; and a stainless steel coil spring upper rail bumper surrounding at least 90 percent of the circular upper rail.

In another embodiment of the invention, a suspended burn cylinder comprises: a reflector/spark screen, a reflector/spark connector plate wherein the reflector/spark connector plate attaches a first portion of the reflector/spark screen to a second portion of the reflector/spark screen, a frame flange wherein the reflector/spark connector plate is attached to the frame flange, a spark screen keeper wherein the spark screen keeper is attached to the frame flange and wherein a portion of the reflector/spark connector is located inside the spark screen keeper, a welded pipe cap base, at least one frame flange to base connector rod wherein the frame flange to base connector rod is attached to the frame flange and to the welded pipe cap base and is configured to maintain a gap between the frame flange and the welded pipe cap base.

In another embodiment of the invention is a method of preventing non-intended fires, the method comprising: starting a fire using firewood inside a reflector/spark screen, the reflector/spark screen comprising a woven matrix of wires, the wires of the woven matrix of wires having a diameter of between 0.02 inches and 0.0625 inches, and the woven matrix of wires having a gap between adjacent wires of between 0.020 and 0.200 inches.

BRIEF DESCRIPTION OF THE DRAWINGS

The drawings are meant to illustrate the principles of the invention and do not limit the scope of the invention. The above-mentioned features and objects of the present disclosure will become more apparent with reference to the following description taken in conjunction with the accompanying drawings wherein like reference numerals denote like elements in which.

DETAILED DESCRIPTION OF THE INVENTION

Figure 1:
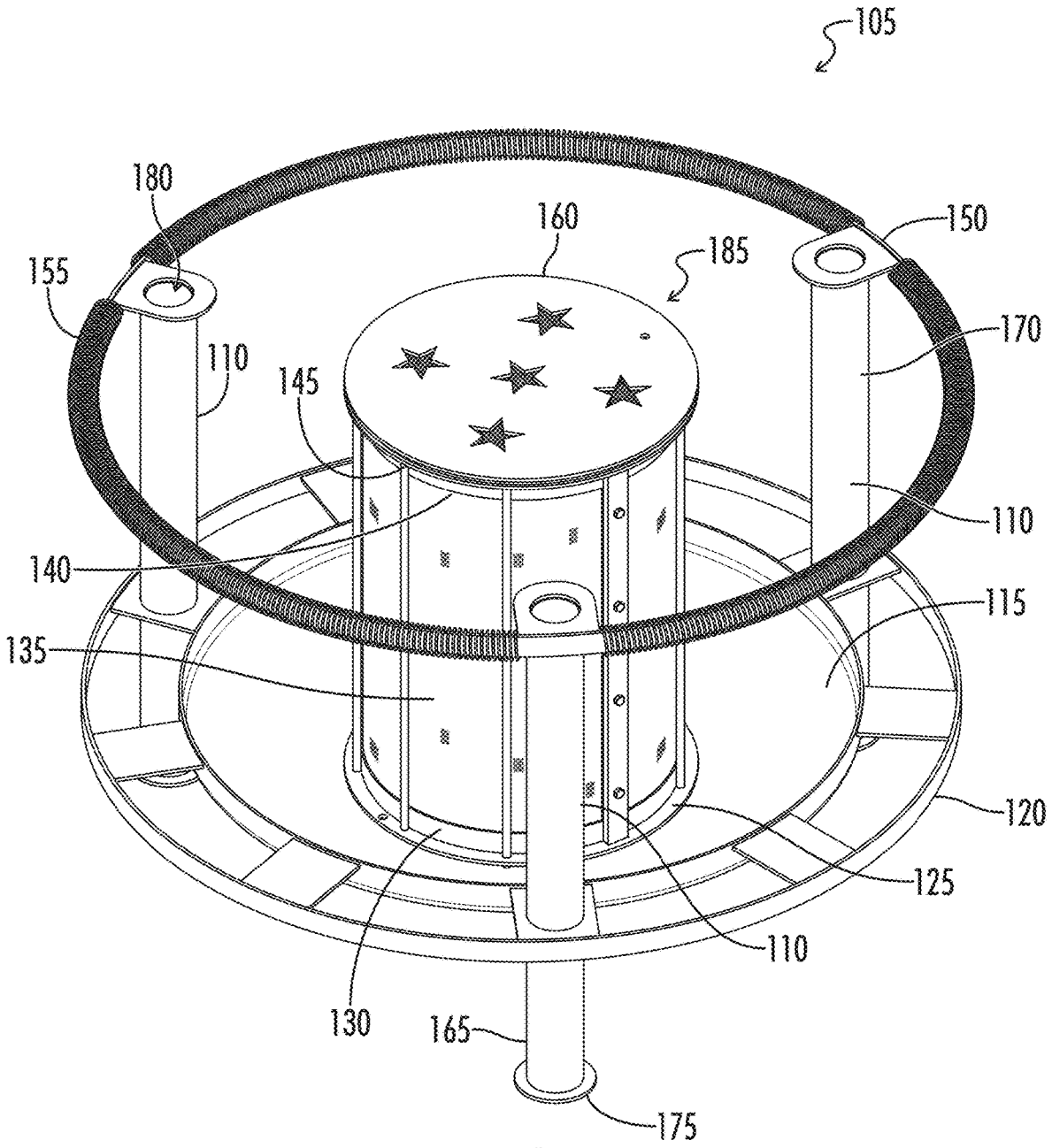
FIG. 1 is a top perspective view of one embodiment of the fire pit of the present invention.

Reference will now be made in detail to the exemplary embodiments of the present disclosure, examples of which are illustrated in the accompanying drawings, wherein like reference numerals refer to like elements throughout. The embodiments are described below so as to explain the present disclosure by referring to the figures. Repetitive description with respect to like elements of different exemplary embodiments may be omitted for the convenience of clarity.

In general, the invention comprises an all-metal, wood-burning, reduced smoke, increased efficiency, essentially flame-contained, spark-suppressed, enhanced safety fire pit/fireplace with a metal screen enclosed vertical combustion column, dual safety rail barriers, manually moveable with incorporated two-wheel design, with grill surface, ash containment and ash removal apparatus, with various cooking implement attachment points, optionally configurable and fitted for either indoor or outdoor use, instantly extinguishable (by covering with the provided balanced handled steel safety barrel), and available with optional picnic table, umbrellas or cooking apparatus.

FIG. 1 is a top perspective view of one embodiment of fire pit 105 of the present invention. Fire pit 105 includes at least three legs 110, a welded pipe cap base 115, a lower rail 120, a lower frame flange 125, a lower spark screen keeper 130, a reflector/spark screen 135, and upper spark screen keeper 140, an upper frame flange 145, an upper rail 150, a coil spring upper rail bumper 155, and a damper lid 160. In a preferred embodiment, lower spark screen keeper 130 is welded to lower frame flange 125 and upper spark screen keeper 140 is welded to upper frame flange 145.

While legs 110 shown in FIG. 1 have a circular cross section (pipes), one of ordinary skill in the art would appreciate that legs 110 could have any shaped cross section. Moreover, while the preferred embodiment uses legs 110 that have a hollow interior, solid legs could also be used. Each of the at least three legs 110 includes a lower portion 165 of the leg 110 which extends from the lower rail 120 to the floor or ground and an upper portion 170 which may extend from the lower rail 120 to the upper rail 150. Each of the at least three legs 110 is attached (directly or indirectly) to the lower rail 120 and the upper rail 150. One of ordinary skill in the art would understand that each of the legs 110 may include the lower portion 165 and the upper portion 170 together as a single structure, or each of the legs 110 may consist of two separate pieces—a lower portion 165 and a separate upper portion 170 which are not connected to each other. One of ordinary skill in the art would appreciate that the welded pipe cap base 115 does not require that it be welded. Preferably welds are used to increase the strength of the connections and the resulting fire pit 105. The bottom opening of each of the at least three legs 110 may be covered by a leg baseplate 175 and the top opening of each of the at least three legs 110 may be covered by a leg cap insert 180. The close tolerance cut leg cap insert 180 prevents foreign material from falling into the leg 110 while maintaining a flush fit with the top of leg 110. The welded pipe cap base 115 is connected to the lower rail 120. As described in more detailed below, the burn cylinder 185 includes: the lower frame flange 125, the lower spark screen keeper 130, the reflector/spark screen 135, the upper spark screen keeper 140, the upper frame flange 145, the frame flange to base connector rods 315 (FIG. 3), the connector rod nuts 725 (FIG. 7), the frame connector rods 310 (FIG. 3), the reflector/spark screen connector plate 315 (FIG. 3), the cap base opening cover 710 (FIG. 7), and damper lid 160.

The lower frame flange 125 is vertically positioned just above the welded pipe cap base 115 such that air flow is permitted between the bottom of the lower frame flange 125 and the top surface of the welded pipe cap base 115. See 405 of FIG. 4. Preferably, the gap between the lower frame flange 125 and the welded pipe cap base 115 is between 0.5 inches and 4 inches but most preferably the gap is one inch. The damper lid 160 may be completely removeable, or it may be moveable (for example hinged or rotatable) so that burnable material, such as wood, may be placed inside the burn cylinder 185 of fire pit 105. If the damper lid 160 is completely removable, it may be keyed such that damper lid 160 can only be attached to the top of the upper frame flange 145 in a specific orientation. See FIG. 12A-12D and the accompanying description. If the damper lid 160 is rotatable, it may include a stopper to ensure that the damper lid 160 does not fall off the top of the fire pit 160 when it is rotated. See FIGS. 11 and 12 and the accompanying description for those figures below. In the preferred embodiment, the damper lid 160 includes opening, but these openings are not required to practice the present invention. In a preferred embodiment, the damper lid 160 has 28% open spaces and 72% closed spaces.

The upper rail 150 and the coil spring upper rail bumper 155 (which encircles the majority of the upper rail 150) provide a "handrail/guardrail" for fire pit 105. Preferably, the coil spring upper rail bumper 155 is made of stainless steel, such that the temperature of the coil spring upper rail bumper 155 is considerably cooler than the temperature of the burn cylinder 185 of fire pit 105. In general, the temperature of the coil spring upper rail bumper 155 remains cool enough that it can be contacted with a hand without being burned. The height of the upper rail 150 and the coil spring upper rail bumper 155 is between 24 inches and 40 inches from the ground (or floor) and most preferably the height is 36 inches from the floor or ground that the fire pit 105 is located on top of. The diameter of the upper rail 150 and the lower rail 120 is between 30 inches and 64 inches, but preferably 52 inches. See FIGS. 5 and 6. This unique safety handrail/guardrail helps to prevent people from falling into the fire or onto the fire pit 105 surface area and helps keep people a reasonable distance to help prevent individuals from accidentally touching the flames or the hot metal on the top of or on the sides of the combustion column of fire pit 105. The safety utility of this handrail bumper is also strong enough to handle a 200 pound downward or inward load in accordance with Occupational Safety and Health Administration standards for handrails.

The upper rail 150 is orientated to present a flat vertical face to the incoming, mostly horizontal, airflow (see 150 of FIG. 4) and the airflow is then forced to circulate around the stainless-steel coil spring upper rail bumper 155. The resulting airflow is generated by the natural draft of vacuum created by air rising in a column as the fire in the center of the fire pit 105 heats the air. Preferably, the coil spring upper rail bumper 155 are comfortable to the touch, have a round cross section, smooth shape and made of 304 stainless steel which does not rust. The coil spring upper rail bumper 155 may also be used as a fire pit 105 hand warmer.

As mentioned above, a leg cap insert 180 may be used to cover the upper opening of each of legs 110. Preferably, each of leg cap inserts 180 are machined to exactly cover the hollow interior of leg 110 without falling inside the hollow interior of leg 110. If leg cap insert 180 is removed, and the legs 110 have a hollow interior, the legs 110 may be used as receivers for telescoping accessory pipes and cooking accessories. See FIGS. 24-26 and 28.

The circular design of both the lower rail 120 (see FIG. 6), and the upper rail 150 (see FIG. 5) allows the fire pit 105 to be positioned on its side and "rolled" from one location to another. See FIG. 27. Generally, the damper top 160 is removed before fire pit 105 is placed on its side and rolled.

The lower rail 120 also helps to prevent children, adults, pets, and flammable objects from falling into fire pit 105 or into the welded pipe cap base 115. The lower rail 120 is preferably between 6 inches and 23 inches off the ground and more preferably 12 inches off the ground.

Figure 2:
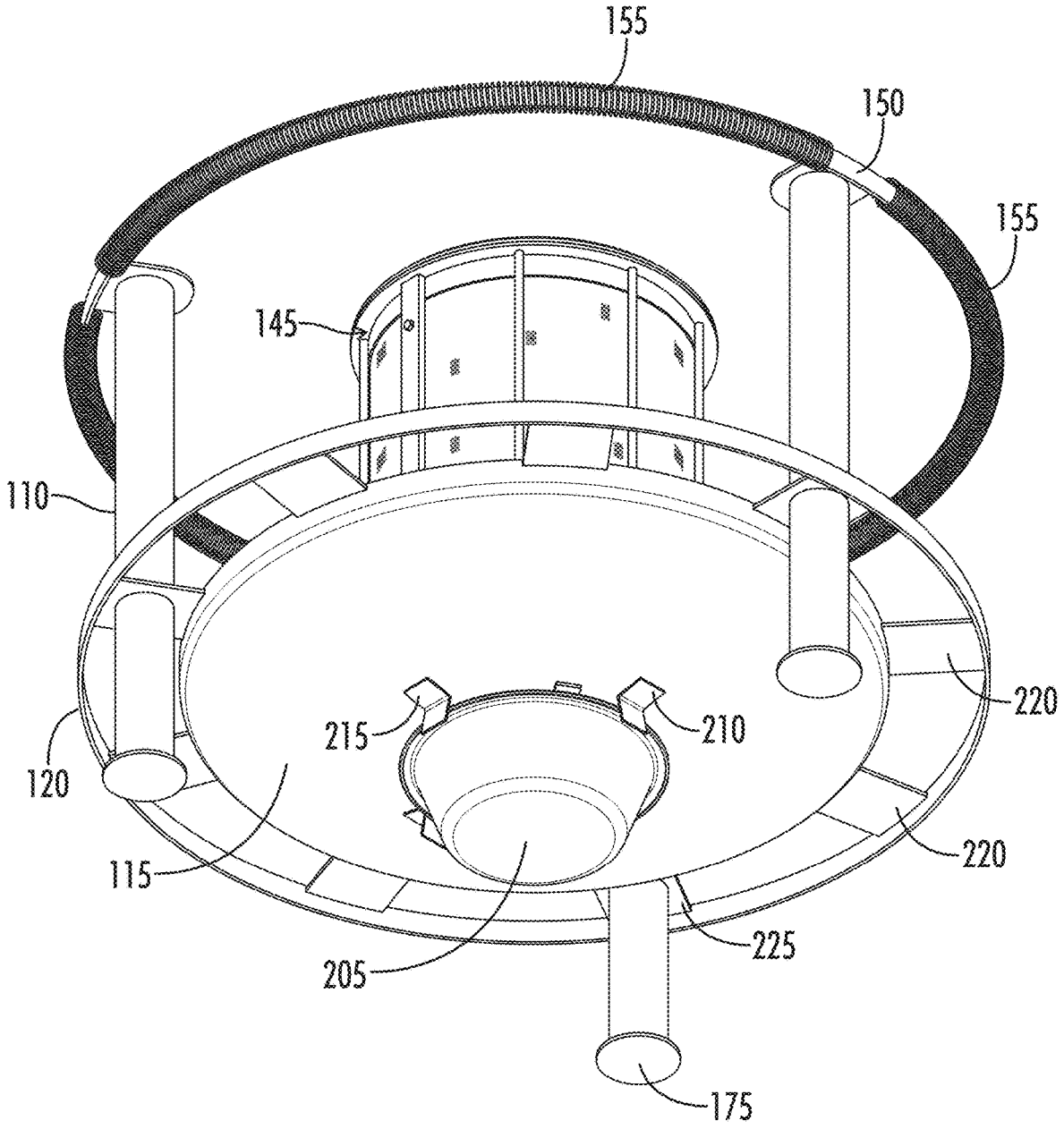
FIG. 2 is a bottom perspective view of the fire pit of FIG. 1.

FIG. 2 is a bottom perspective view of fire pit 105 of FIG. 1. The welded pipe cap base 115 may have a cap base opening, such as a hole (705 of FIG. 7), in the center section (or near the center section) to assist in the removal of ashes and burned material. If a cap base opening 705 is included, a portion of the cap base opening 705 may be covered with a cover opening (see 715 of FIG. 7). If a cap base opening 705 is included in the welded pipe cap base 115, an ash pan 205 may be attached to the welded pipe cap base 115 or positioned underneath the cap base opening 705 in the welded pipe cap base 115 to catch ash and/or burned material. If an ash pan 205 is attached to welded pipe cap base 115, the ash pan 205 may have tabs 210 or similar means to attach and/or guide the ash pan 205 to the welded pipe cap base 115. In addition, an ash pan stopper 215 may be included to ensure that the ash pan 205 is correctly positioned below the cap base opening 705 (FIG. 7) when the ash pan 205 is attached. See FIG. 6 and the accompanying description below. The ash pan 205 may also be configured so that the ash pan 205 can only be attached to the welded pipe cap base 115 in a specific orientation.

The lower rail 120 may be solid (not shown) or it may include lower rail spokes 220 as shown in FIG. 2. Lower rail leg spokes 220 are a unique attachment plate that transfers more strength and stability by (for example) welding the welded pipe cap base 115 to the lower rail spoke leg spokes 220. This preferred configuration (the use of lower rail leg spokes 220) provides enormous vertical compression strength and more horizontal strength from a wider, more stable footprint than can be achieved by welding legs directly to the welded pipe case base 115. This additional strength is passed upward to upper rail 150. This design makes the fire pit 105 self-supporting when any additional loads overhead are present such as when an exhaust vent hood (see FIGS. 24 through 26) or when cooking accessories (see FIG. 28) are attached. The legs 110 may be attached directly to the lower rail 120 or the legs 110 may be attached to lower rail leg spokes 220 as shown in FIG. 2.

Figure 3:
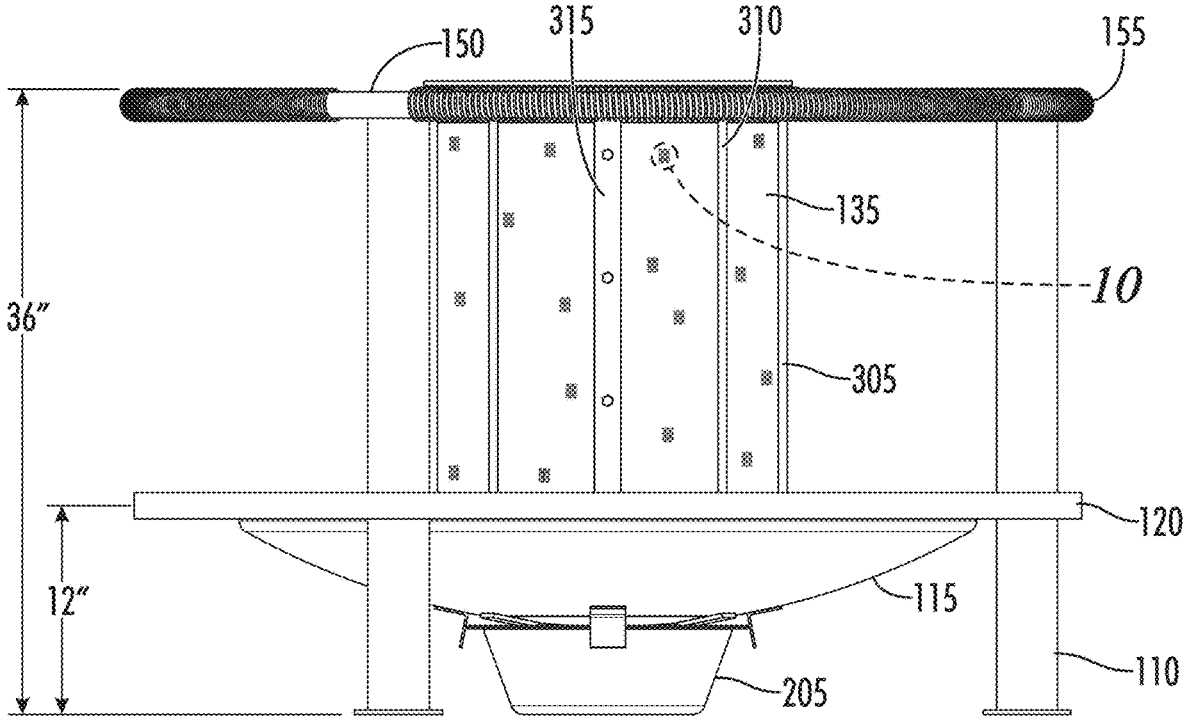
FIG. 3 shows a side view of the fire pit of FIG. 1.
Figure 4:
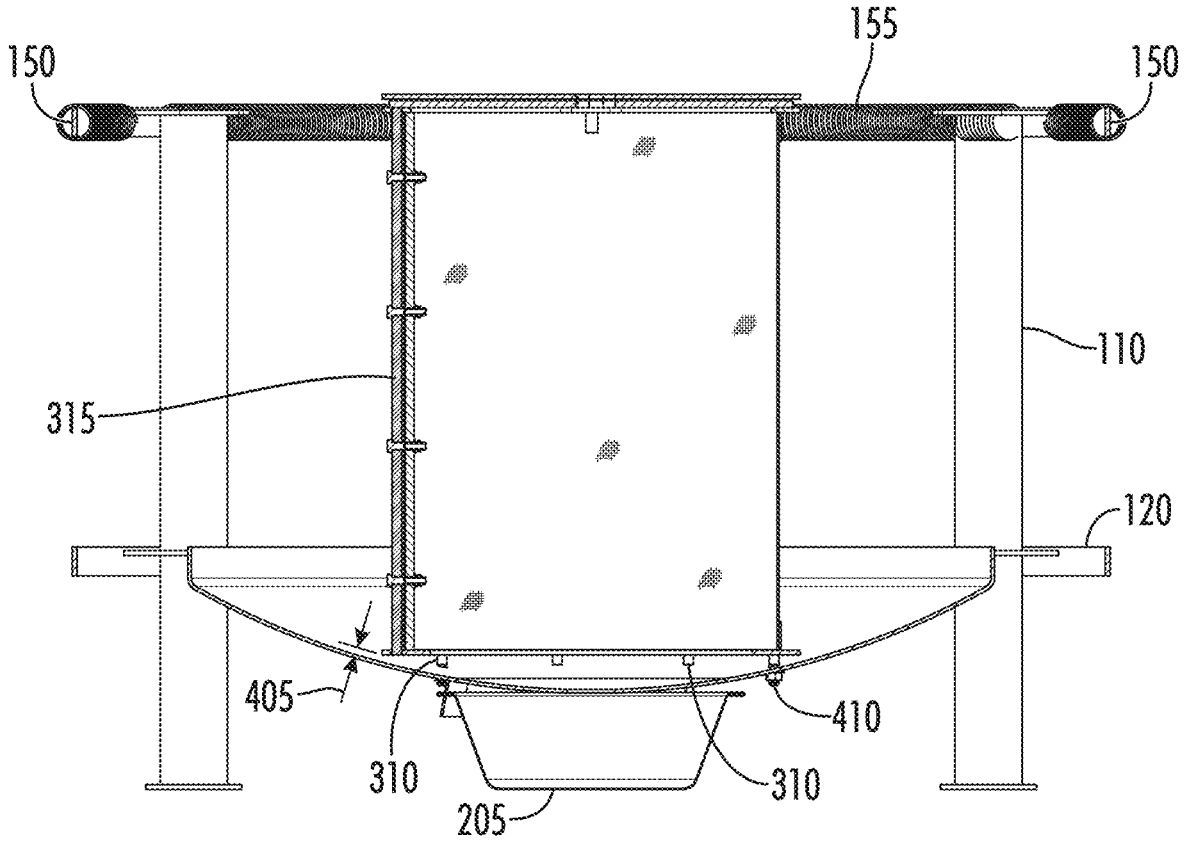
FIG. 4 shows a cross-section of the fire pit of FIG. 1 from line 4-4 on FIG. 5.

FIG. 3 shows a side view of the fire pit 105 of FIG. 1. As shown in FIG. 3, the reflector/spark screen 135 is preferably held in place vertically by attaching two portions of the reflector/spark screen 135 (such as the two ends of the reflector/spark screen 135) to a reflector/spark connector plate 315 and attaching the reflector/spark connector plate 315 to either the lower frame flange 125, or the upper frame flange 145, or to both the lower frame flange 125 and the upper frame flange 145. The reflector/spark screen 135 is preferably held in place horizontally when the bottom of the reflector/spark screen 135 is place within the lower spark screen keeper 130 (which is attached to the lower frame flange 125) and/or the top of the reflector/spark screen 135 is placed within the upper spark screen keeper 140 (which is attached to the upper frame flange 145). The bottom of the reflector/spark screen 135 may rest on the lower frame flange 125, but the reflector/spark screen 135 is not directly connected to the lower frame flange 125. In addition, the reflector/spark screen 135 is also held in place horizontally by the use of at least one frame connecting rod 310 which connects the upper frame flange 145 to the lower frame flange 125. In a preferred embodiment, 9 frame connecting rods 310 are used which are welded into place. In turn, the upper frame flange 145 and the lower frame flange 125 are vertically held in place by at least one frame flange to base connecting rod 305 and a connector rod nut 410 (FIG. 4). Preferably, the frame flange to base connector rod 305 extends through the lower frame flange 125. The bottom of the frame flange to base connector rods 305 is connected to the welded pipe cap base 115. See FIG. 4. In a preferred embodiment three frame flange to base connecting rods 305 and three connector rod nuts 410 are used. The portion of the frame flange to base connector rods 305 that extends between the lower frame flange 125 and the top of the welded pipe cap base 115 ensures that a gap remains between the bottom of lower frame flange 125 and the top of the welded pipe cap base 115 of between 0.5 inches and 4 inches but most preferably of approximately one inch.

Preferably, the reflector/spark screen 135 is not connected to: (1) the lower spark screen keeper 130, (2) the lower frame flange 125, (3) the upper spark screen keeper 140, or (4) the upper frame flange 145. The absence of a direct connection between the reflector/spark screen 135 and the lower frame flange 125, the lower spark screen keeper 130, the upper spark screen keeper 140, and the upper frame flange 145 extends the life of the reflector/spark screen 135 through the heating and cooling cycles the reflector/spark screen 135 experiences. The implementation of the lower spark screen keeper 130, the upper spark screen keeper 140, the upper frame flange 145, the lower frame flange 125, the reflector/spark screen 135 and the frame connector rods 310 help to allow for the expansion and contraction of the reflector/spark screen 135 to prevent tearing of the reflector/spark screen 135. If the reflector/spark screen 135 was attached by bolts, screws, or wielding, to anything other than the reflector/spark connector plate 315, the reflector/spark screen 135 would be damaged when the reflector/spark screen 135 expands and contracts because of the heat the reflector/spark screen 135 experiences. The lower frame flange 125 also provides a ledge for firewood to rest on that prevents firewood from falling flat on the surface of the welded pipe cap base 115. By elevating the firewood in this manner, it is believed that the firewood is better exposed to heat and oxygen and the firewood burns cleaner and more efficiently.

The height and narrowness of the burn cylinder 185 forces firewood to stack leaning against the reflector/spark screen 135 thereby leaving space between the firewood for more exposure to heat from the coals and fresh super-heated oxygen rising from the flames beneath giving a cumulative increase in the overall heat in the fire chamber resulting in a much more efficient fire. The preferred height of the burn cylinder 185 is between 24 inches and 36 inches, most preferably 27.5 inches and the preferred diameter of the burn cylinder 185 is between 16 and 22 inches, most preferable 19 inches.

The reflector/spark screen 135 mesh of the present invention is preferably composed of a 10×10 woven mesh per square inch where the diameter of the wires used in the mesh are between 0.020 inches and 0.0625 inches but most preferably 0.047 inches. This results in a screen which consists of approximately 72% closed spaces and 28% open spaces in the wire mesh. The screens used in most fire pits are predominately "open" mesh which has a greater amount of open space in the mesh than closed space. This "open" mesh design has several drawbacks. First, the open mesh design fails to reflect sufficient heat back into the fire to reduce the amount of smoke produced by the fire. Second, the open mesh design of other fire pits allows large sparks to pass through the open mesh screen increasing the possibility of burns and resulting fires. While the open mesh design of other fire pits permits the fire to be seen and enjoyed by the participants more easily, the drawbacks far outweigh this single advantage. It is desirable to reflect at least 10% to 90% (most preferably greater than 50%) of the heat generated by the fire back into the fire which is believed to have a multiplying effect on the temperature inside the fire chamber which results in a much hotter, efficient, and cleaner burning fire. Additionally, because of the size of the screen mesh, sparks greater in size than the opening in the screen mesh are prevented from escaping from the burn cylinder 185. Escaping sparks are therefore limited in size and subsequently the escaping sparks are limited in travel time and travel distance after passing through the reflector/spark screen 135. Moreover, reducing the size of the gaps in the screen of the present invention reduces the life span of sparks escaping at ignition temperature (about 300 degrees) to less than one second, further reducing the possibility that these sparks will ignite any material outside of the burn cylinder 185.

Figure 5:
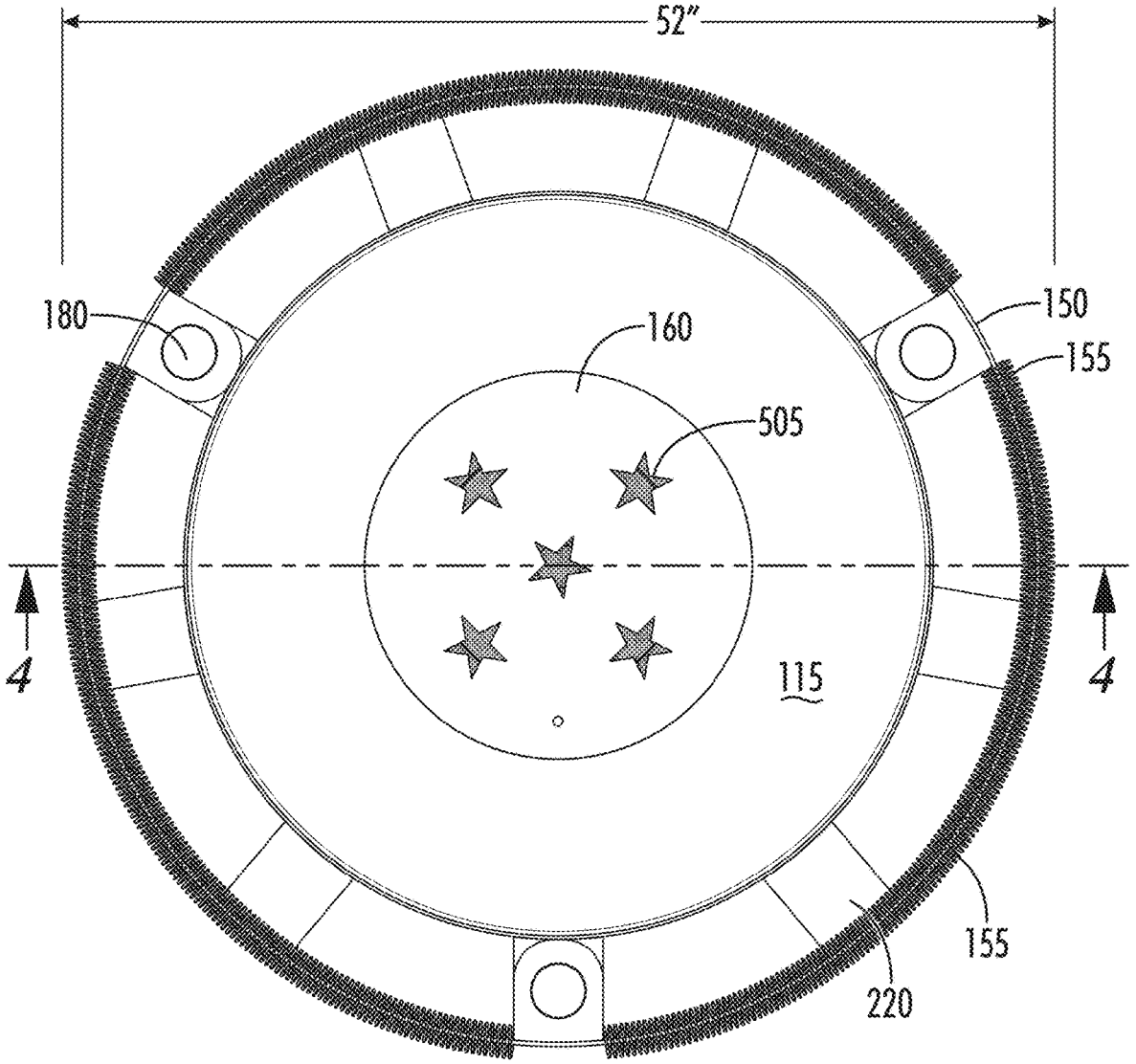
FIG. 5 shows a top view of the fire pit of FIG. 1.

FIG. 4 shows a cross-section of the fire pit 105 of FIG. 1 from line 4-4 on FIG. 5. FIG. 4 shows how the frame flange to base connector rods 305 pass through the bottom of the lower frame flange 125 and through the welded pipe cap base 115. FIG. 4 also shows that the frame connector rods 310 are attached to the lower frame flange 125 but the frame connector rods 310 do not pass through to the welded pipe cap base 115. FIG. 4 also includes a cross-section of the reflector/spark connector plate 315 and the vertical orientation of the upper rail 150 inside the surrounding coil spring upper rail bumper 155.

FIG. 5 shows a top view of the fire pit 105 of FIG. 1. As illustrated, damper lid 160 has 5 smaller stars cutouts 505. One of ordinary skill in the art would appreciate that the cutouts can be of any shape. No matter the shape of the cutouts, the percentage of the openings in the damper lid 160 is preferably between 0% and 50% to serve as a damper and reduce (or eliminate) the amount of smoke generated by fire pit 105. Most preferably, the percentage of the openings in the mesh used in the damper lid is 28% open and the stars (or other opening on the damper lid 160) is 6.5% of the area of the damper lid 160.

Figure 6:
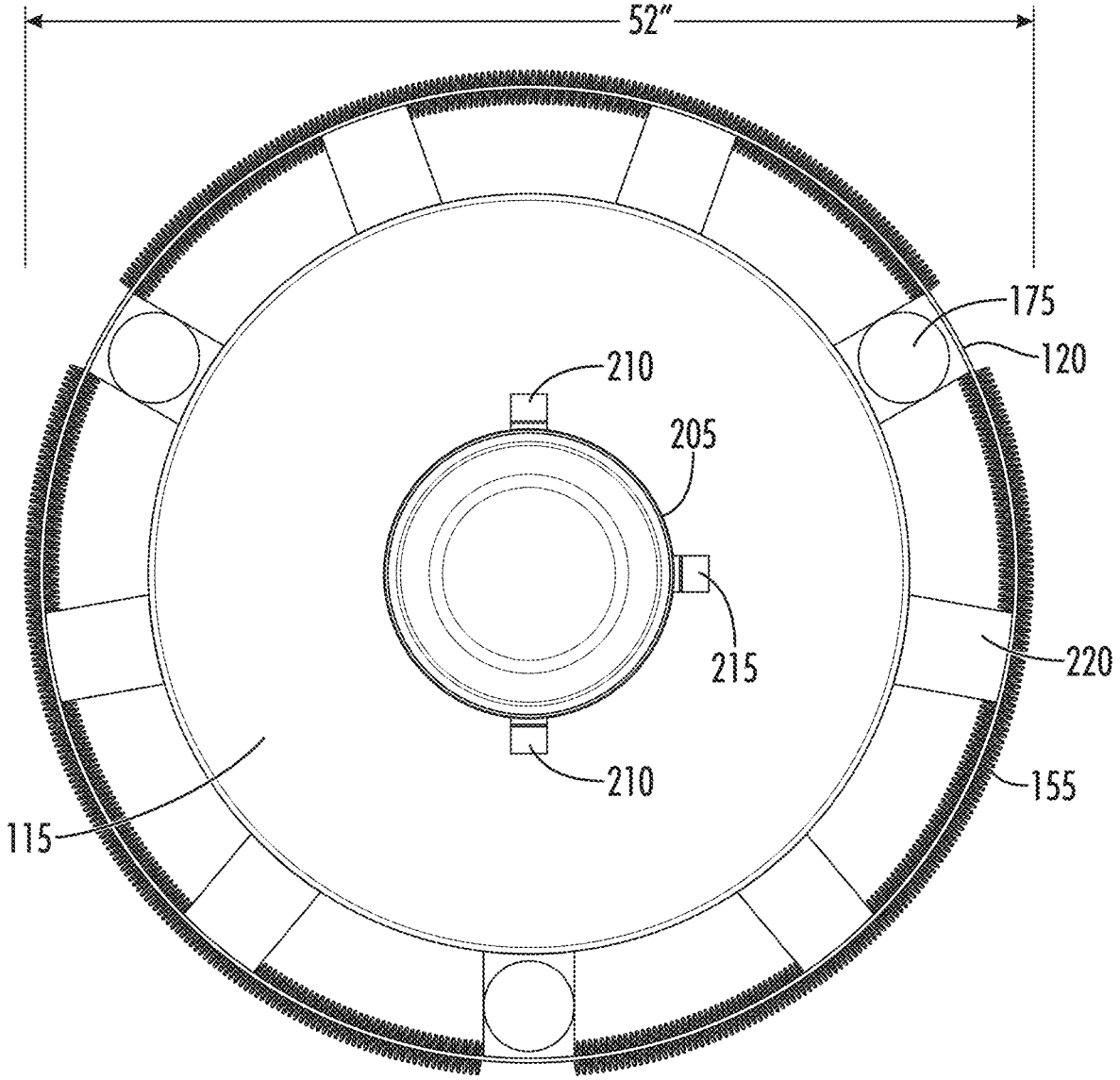
FIG. 6 shows a bottom view of the fire pit of FIG. 1.

FIG. 6 shows a bottom view of the fire pit 105 of FIG. 1. In some embodiments, the position of the ash pan 205 may be determined through the use of tabs 210 and an ash pan stopper 215.

Figure 7:
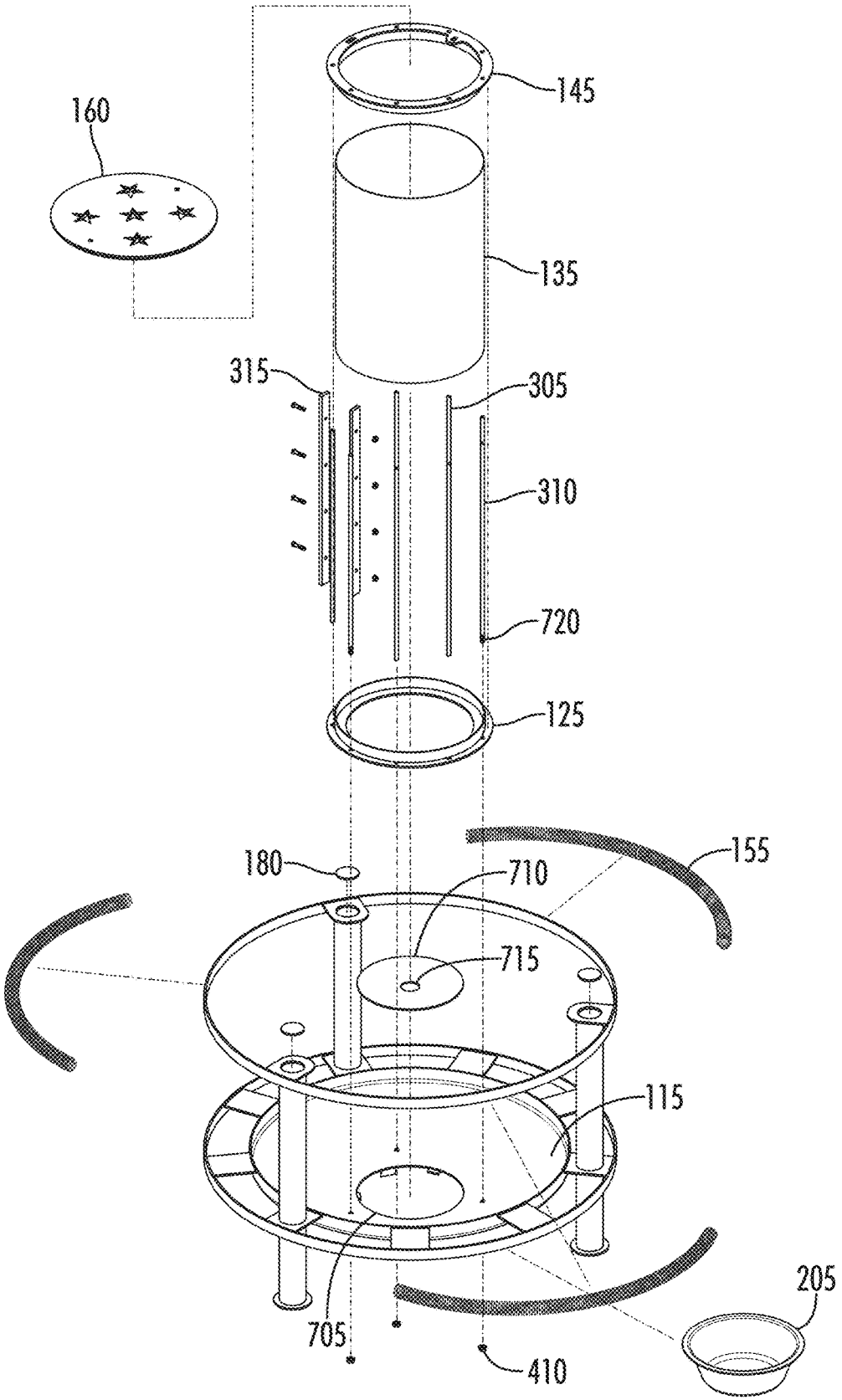
FIG. 7 is an exploded view of the fire pit of FIG. 1.

FIG. 7 is an exploded view of the fire pit 105 of FIG. 1. As shown in FIG. 7, the welded pipe cap base 115 may include a cap base opening 705 in the center (or near the center) to assist in the removal of ash and/or burned material. A cap base opening cover 710 is used to cover the majority of cap base opening 705. The cape base opening cover 710 also includes a cover opening 715 which can be used to easily displace or remove the opening cover 710 from the welded pip cap base 115 and/or from fire pit 105. See FIGS. 13 and 14 and the related descriptions below. As shown in FIG. 7, preferably the frame flange to base connector rods 305 have a threaded lower end 720 in which nuts 410 can be used to attach the threaded end 720 of the frame flange to base connector rods 305 to the welded pipe cap base 115.

Figure 8A:
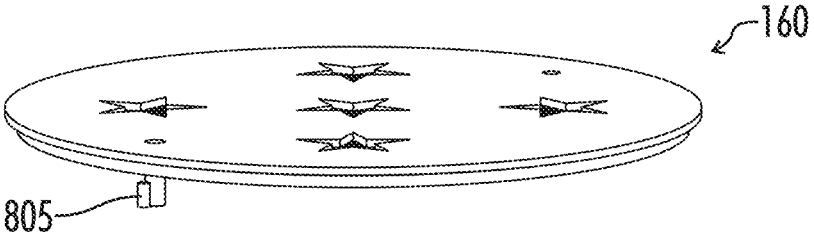
FIG. 8A shows a top perspective view of the damper lid.
Figure 8B:
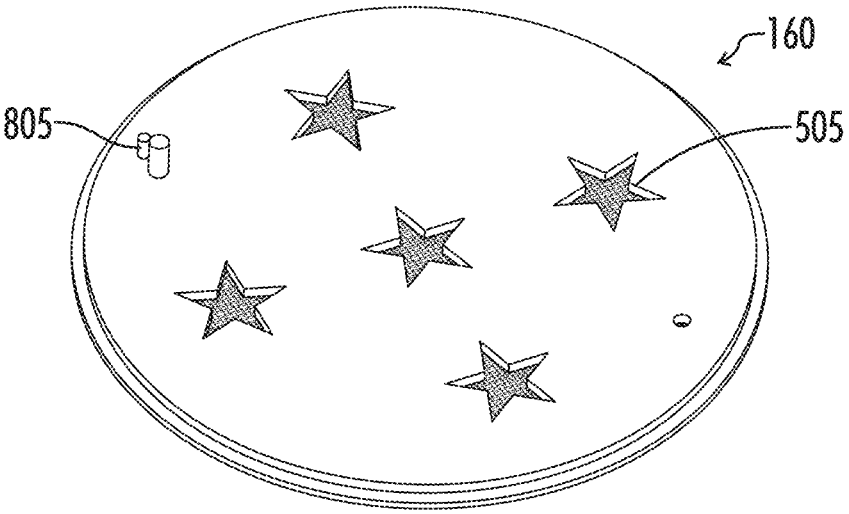
FIG. 8B shows a bottom perspective view of the damper lid.

FIG. 8A is a top perspective view of the damper lid 160 and FIG. 8B shows a bottom perspective view of the damper lid 160. Damper lid 160 may include stopper 805 to hold the damper lid 160 to the fire pit 105 while damper lid 160 is rotated to add more wood to the burn cylinder 185.

Figure 9:
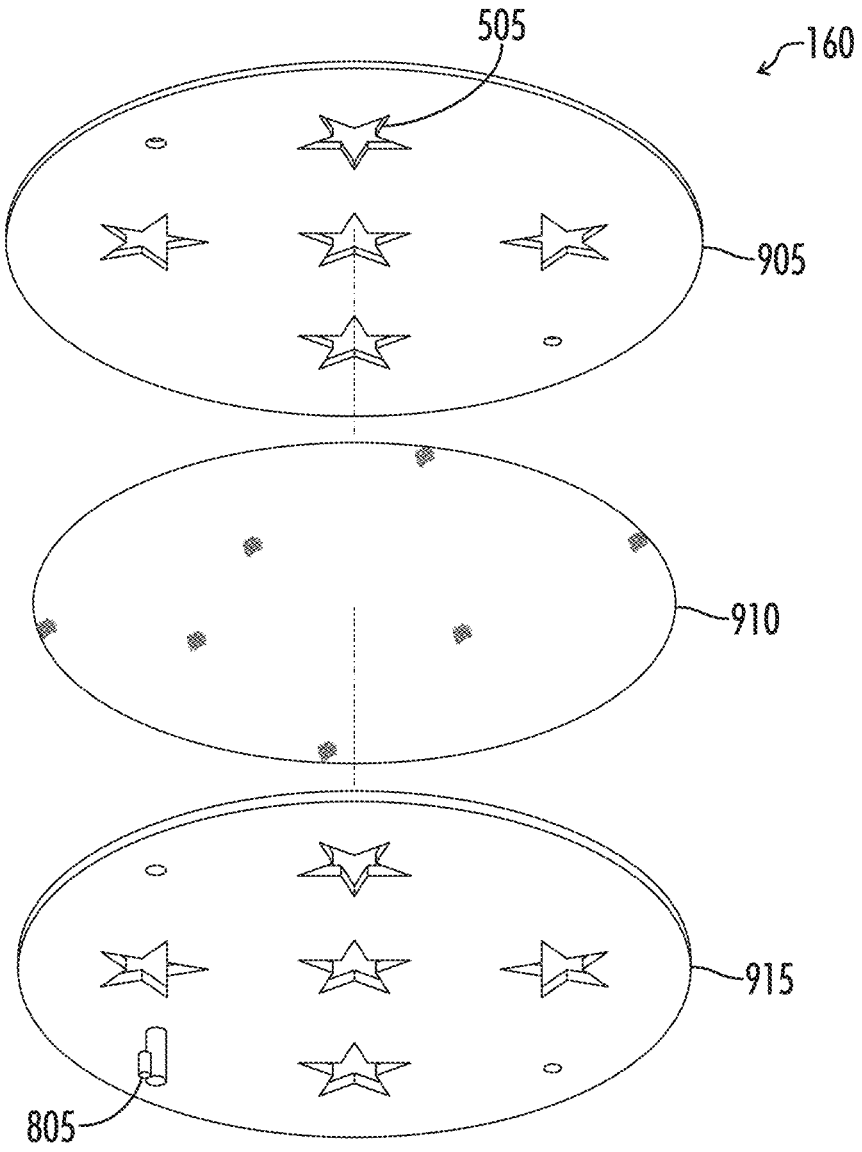
FIG. 9 shows an embodiment of damper lid 160 which includes three layers, a top layer, a middle layer, and a bottom layer.

FIG. 9 shows an embodiment of damper lid 160 which includes three layers, a top layer 905, a middle layer 910, and a bottom layer 915. In a preferred embodiment the top layer 905 is approximately 0.25 inches thick, the middle later 910 is made of a woven screen material with 72% closed space and 28% open space, and the bottom layer 915 is 0.375 inches thick. In a preferred embodiment, the top layer 905 is stitch welded with 3 inch welds, to the bottom layer 915, while "sandwiching" the middle layer 910 in between the top layer 905 and the bottom layer 915. Using different thicknesses for the top layer 905 and the bottom layer 915 helps prevent warping of the damper lid 160.

Figure 10:
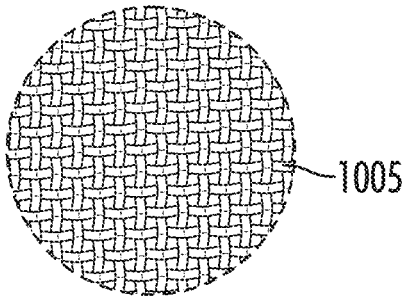
FIG. 10 shows an enlarged view of a portion of the reflector/spark screen 135 from FIG. 3.

FIG. 10 shows an enlarged view of a portion of the reflector/spark screen 135 from FIG. 3. The reflector/spark screen 135 is preferably made of 304 stainless steel wire 10×10 woven mesh (18 gauge, and 0.047 inch diameter) and has an open area of 28% and a closed area of 72%. Preferable, reflector/spark screen 135 is preferably made of a woven material with holes 1005 between 0.020 inches and 0.0625 inches and most preferably 0.047 inches wide. Keeping the holes this size (or smaller) helps prevent large embers from escaping from the fire pit 105.

Figure 11A:
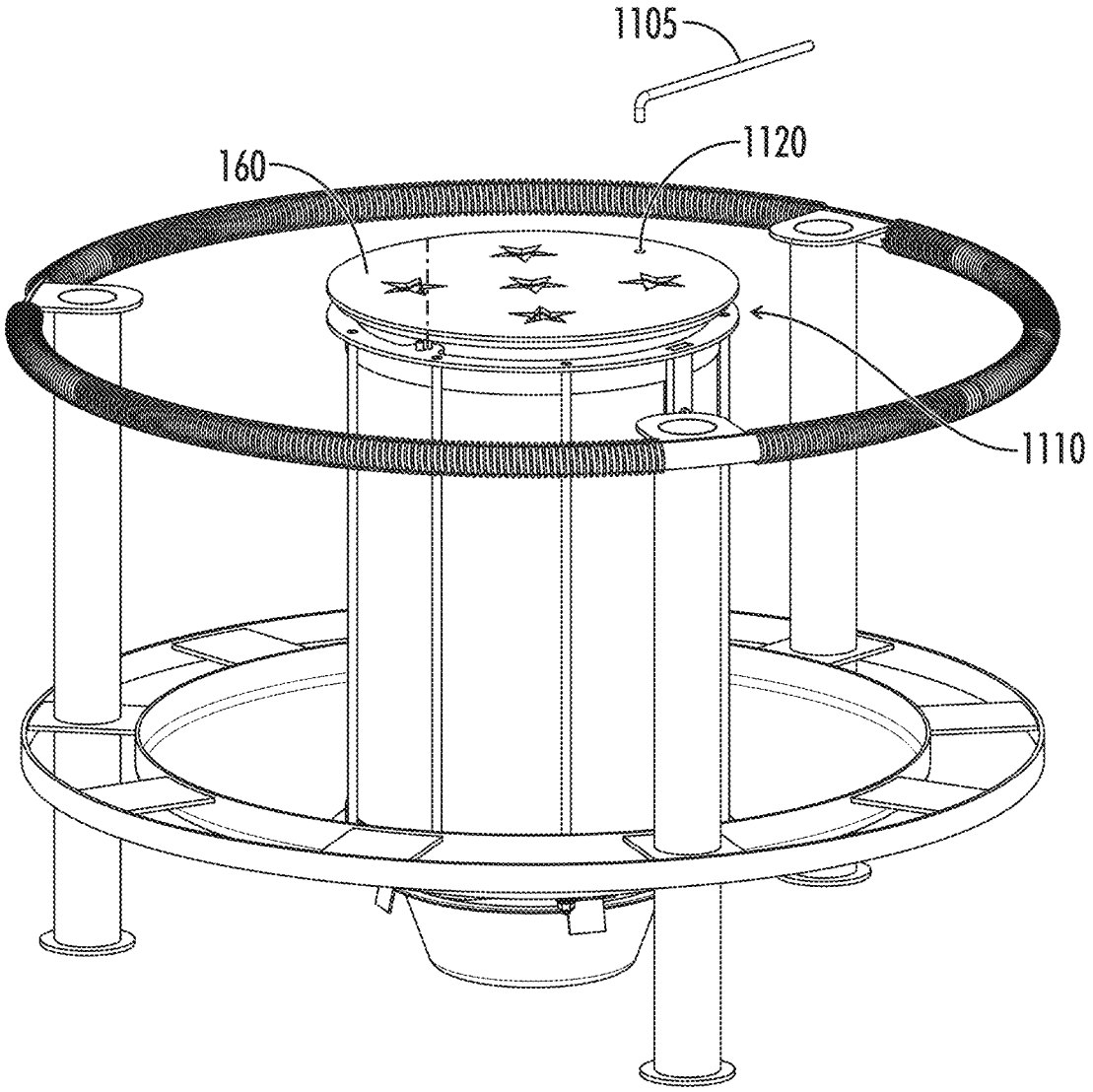
FIGS. 11A through 11D show the use of a damper lid tool to rotate the damper lid from a closed position to an open position.
Figure 11B:
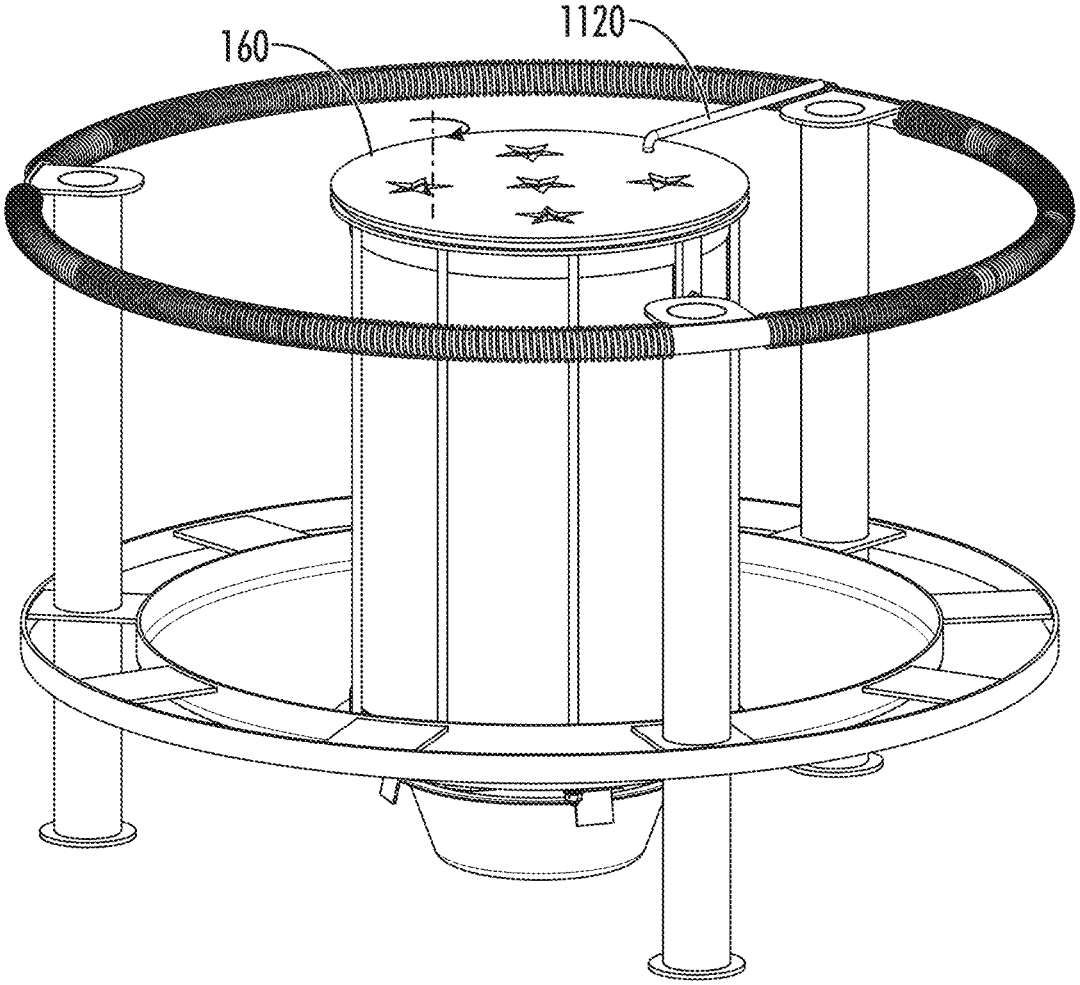
Figure 11C:
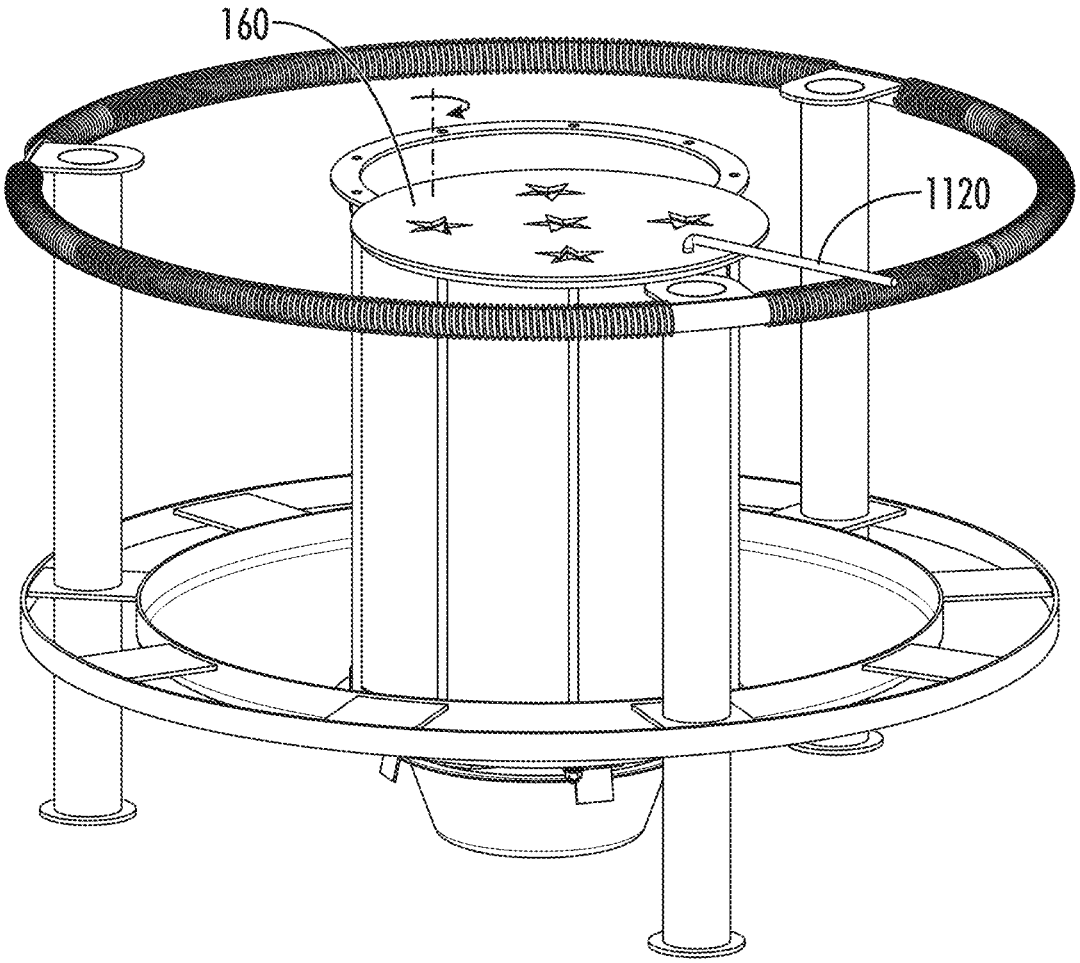
Figure 11D:
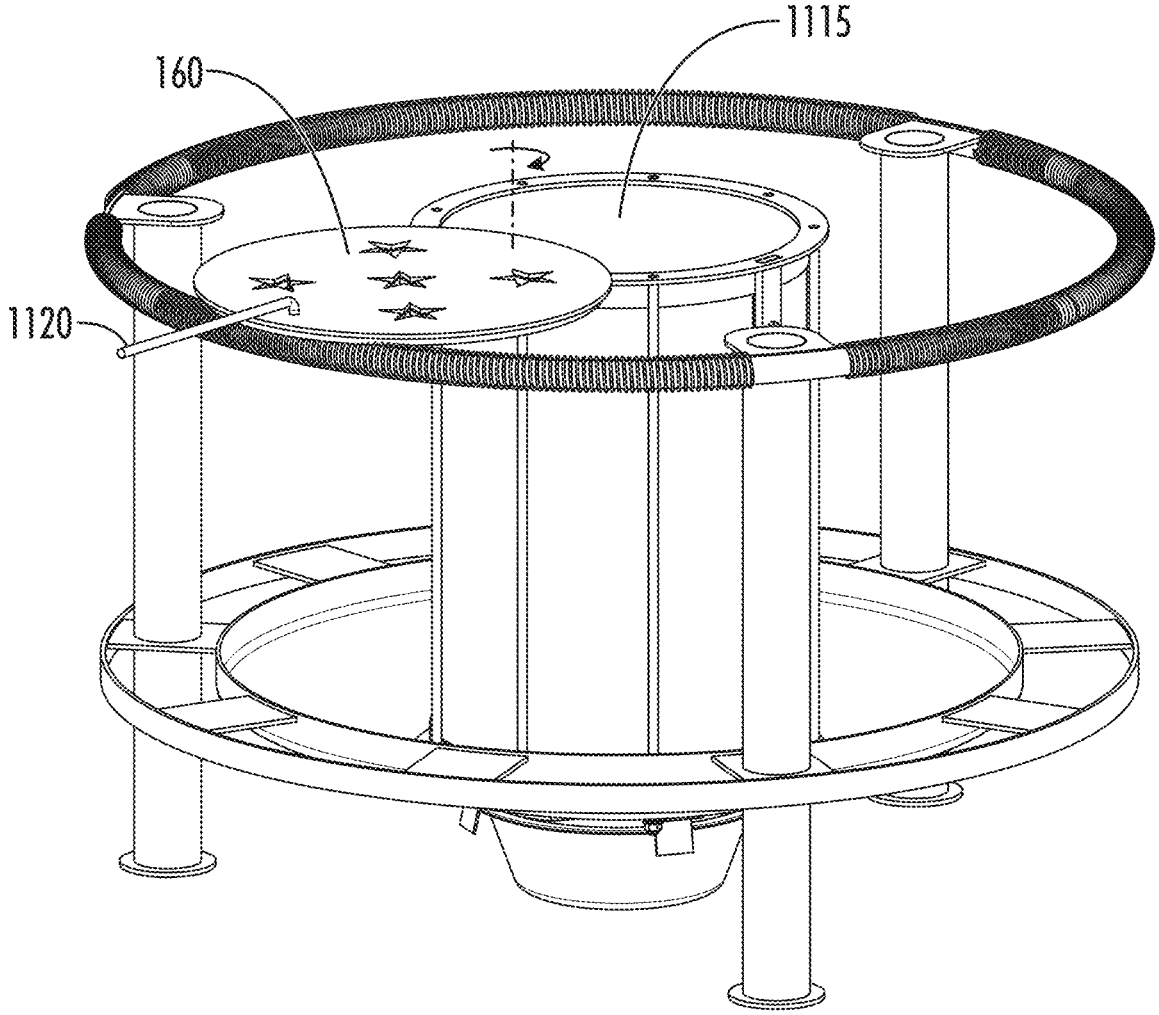

FIGS. 11A through 11D show the use of a damper lid tool 1105 to rotate the damper lid 160 from a closed position 1110 (FIG. 11A) to an open position 1115 (FIG. 11D). Damper lid tool 1105 is inserted into the damper lid tool keyway 1120 (See FIG. 11B) and is used to rotate the damper lid 160. Reasons why the damper lid 160 would be rotated to the open position 1115 include to add additional wood to the burn cylinder 185 of the fire pit 105 or to cook above fire pit 105.

Figure 12A:
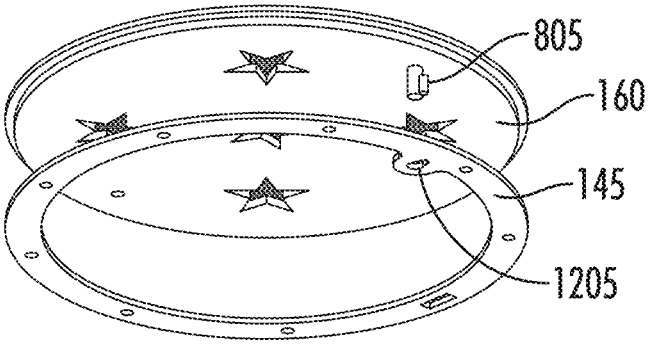
FIGS. 12A through 12D show how the stopper attached to the damper lid interacts with the upper frame flange to permit the rotation of damper lid while ensuring that the damper lid stays attached to the fire pit.
Figure 12B:
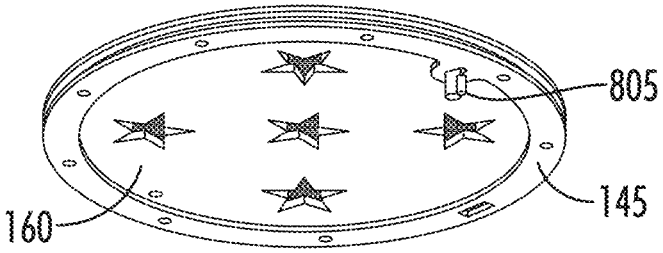
Figure 12C:
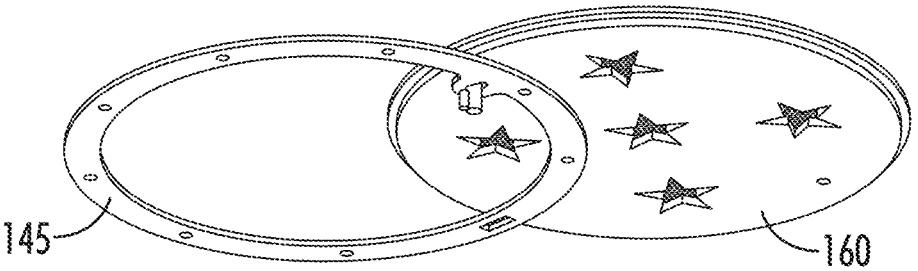
Figure 12D:
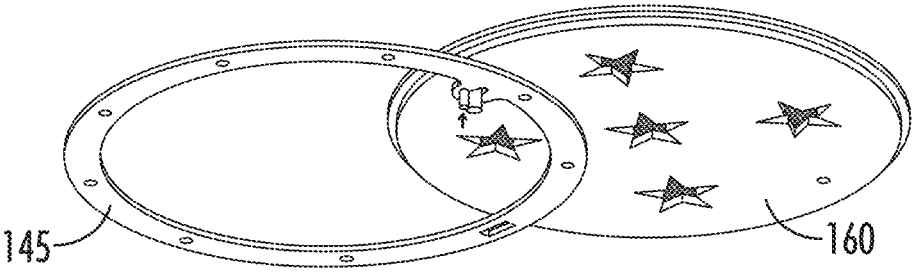

FIGS. 12A through 12D show how the stopper 805 attached to the bottom side of the damper lid 160 interacts with the stopper keyway 1205 of the upper frame flange 145 to permit the rotation of damper lid 160 while ensuring that the damper lid 160 does not fall off of fire pit 105. FIG. 12A shows the damper lid 160 with the stopper 805 above and aligned with the upper frame flange 145. FIG. 12B shows the stopper 805 aligned with the stopper keyway 1205 in the upper frame flange 145, the damper lid 160 is resting on top of the upper frame flange 145, and the damper lid 160 can be removed from fire pit 105 (because the stopper 805 is aligned with the stopper keyway 1205). FIGS. 12C and 12D show damper lid 160 rotated so that the damper lid 160 and the upper frame flange 145 are no longer aligned above each other, and stopper 805 prevents the damper lid 160 from coming off or falling off of the top of fire pit 105. The interaction of stopper 805 and stopper keyway 1205 permits the rotation of the damper lid 160 while preventing the damper lid 160 from being removed unless it is in the correct position as illustrated in FIG. 12B. Damper lid 160 is rotated, for example, to add wood to the burn cylinder 185 of fire pit 105 or to cook over the fire pit 105. Damper lid 160 cannot be removed from fire pit 105 unless the damper lid 160 is properly positioned with respect to upper frame flange 145.

Figure 13A:
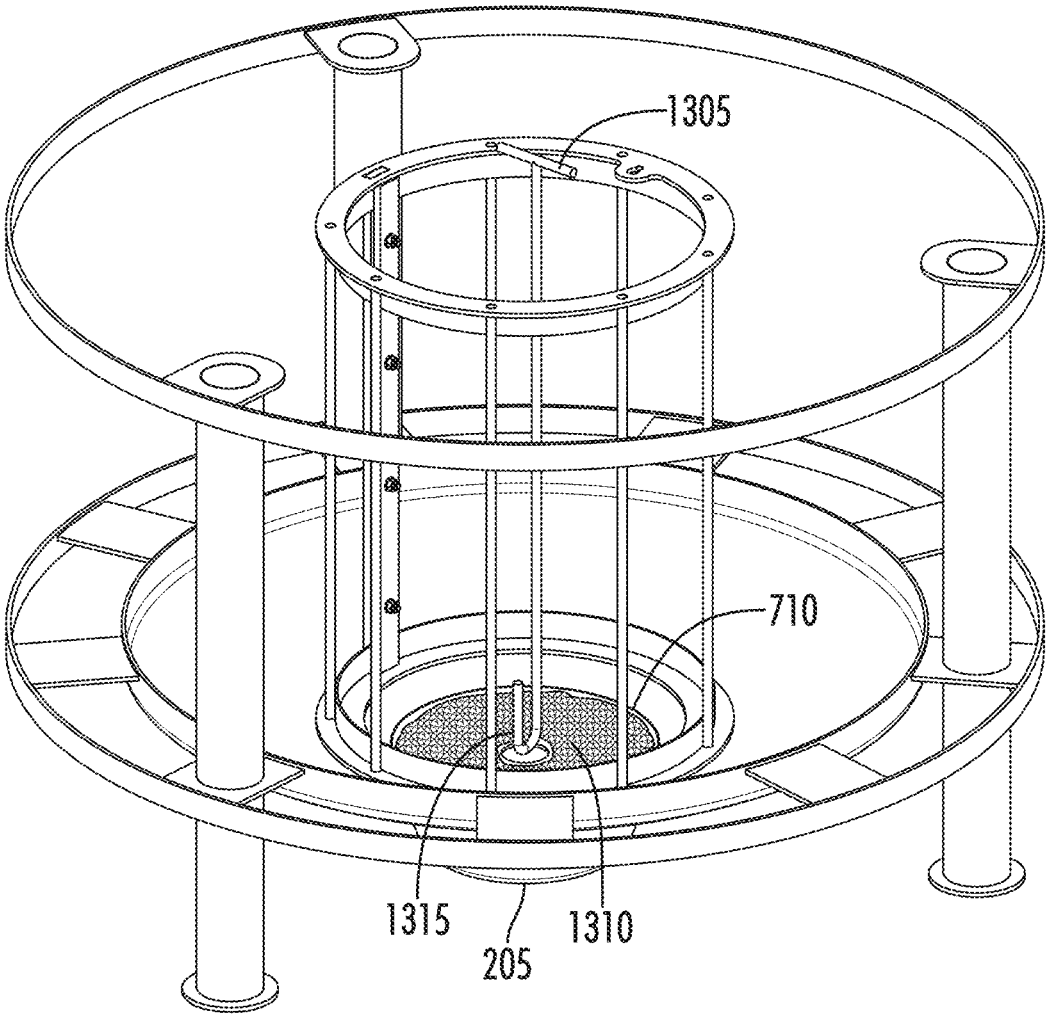
FIGS. 13A through 13E show the fire pit of FIG. 1 (with the reflector/spark screen removed) to illustrate how a cover removal tool can be used to remove (or displace) the opening cover from the fire pit.
Figure 13B:
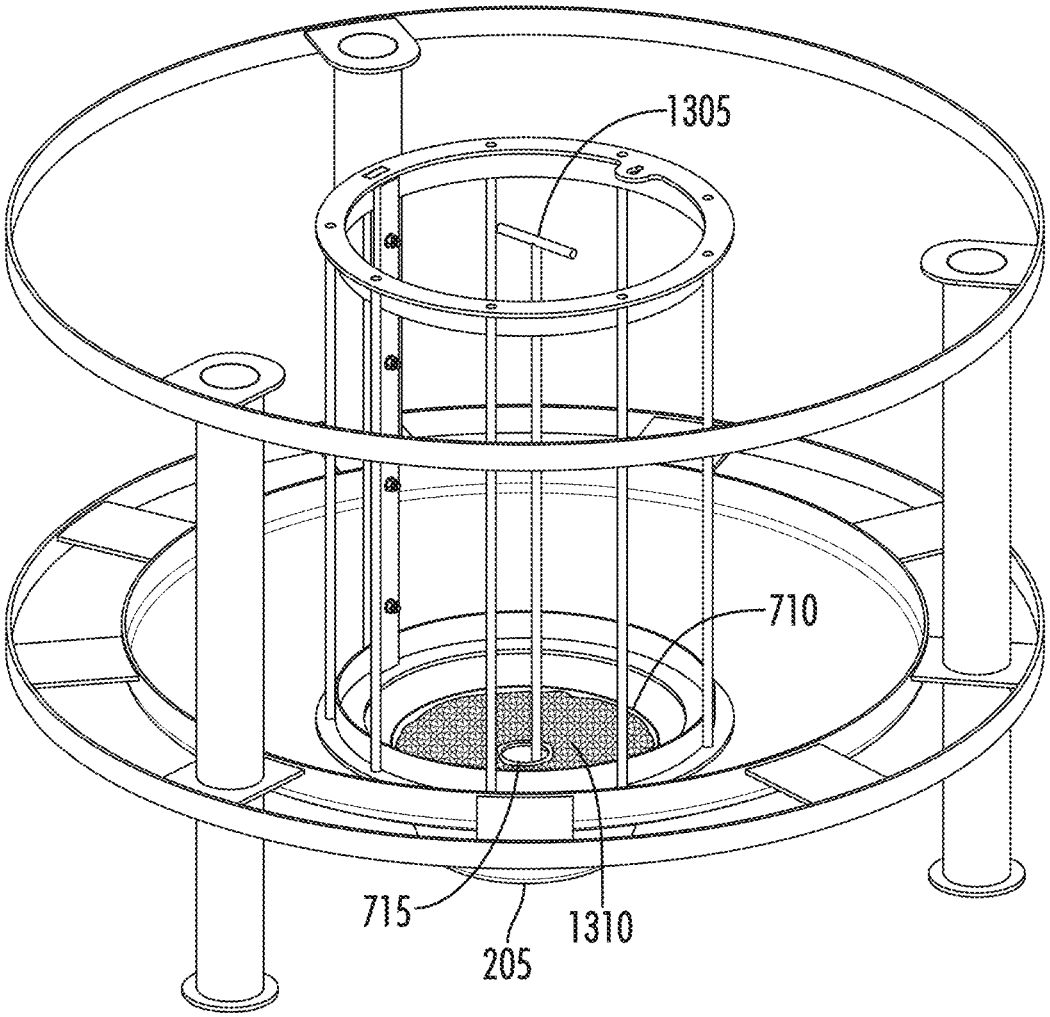
Figure 13C:
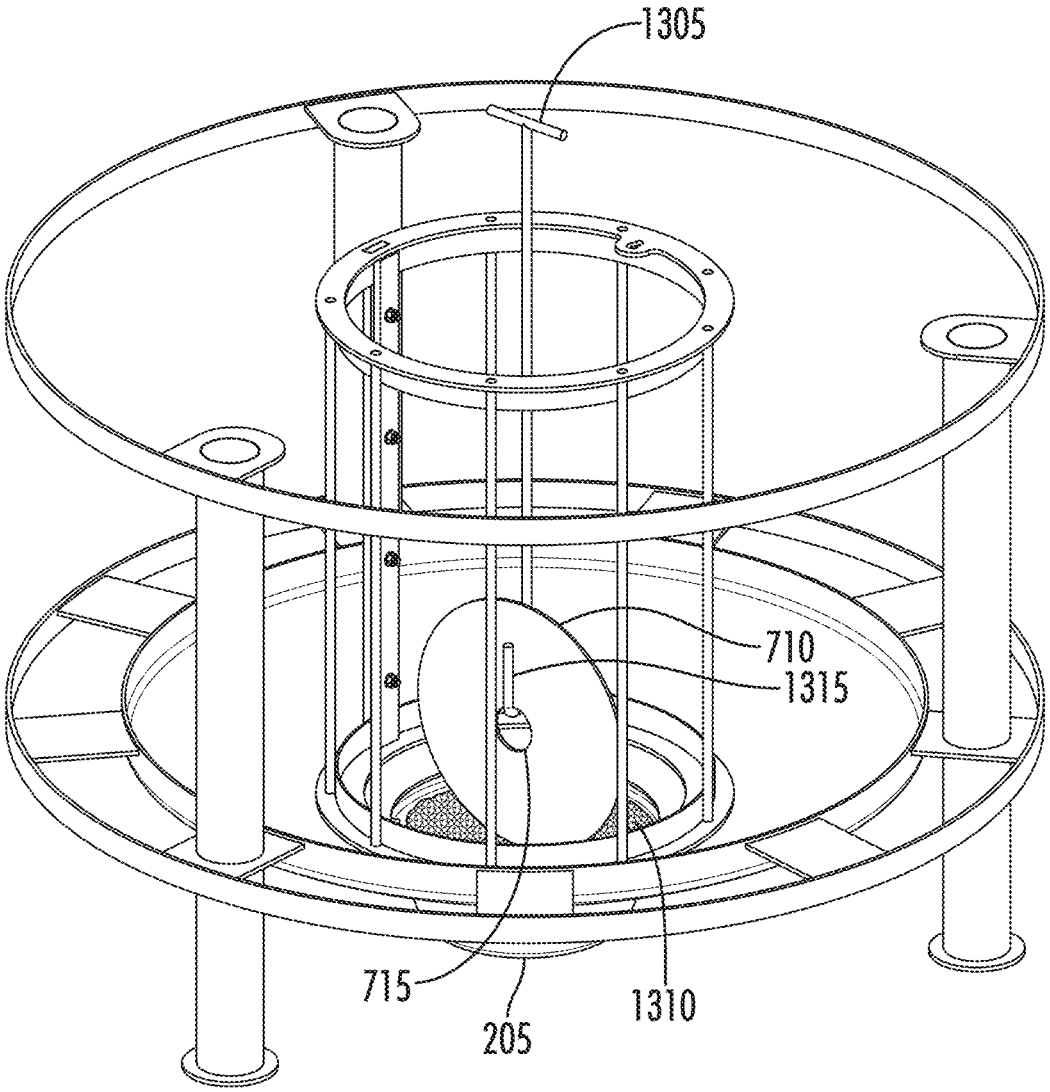
Figure 13D:
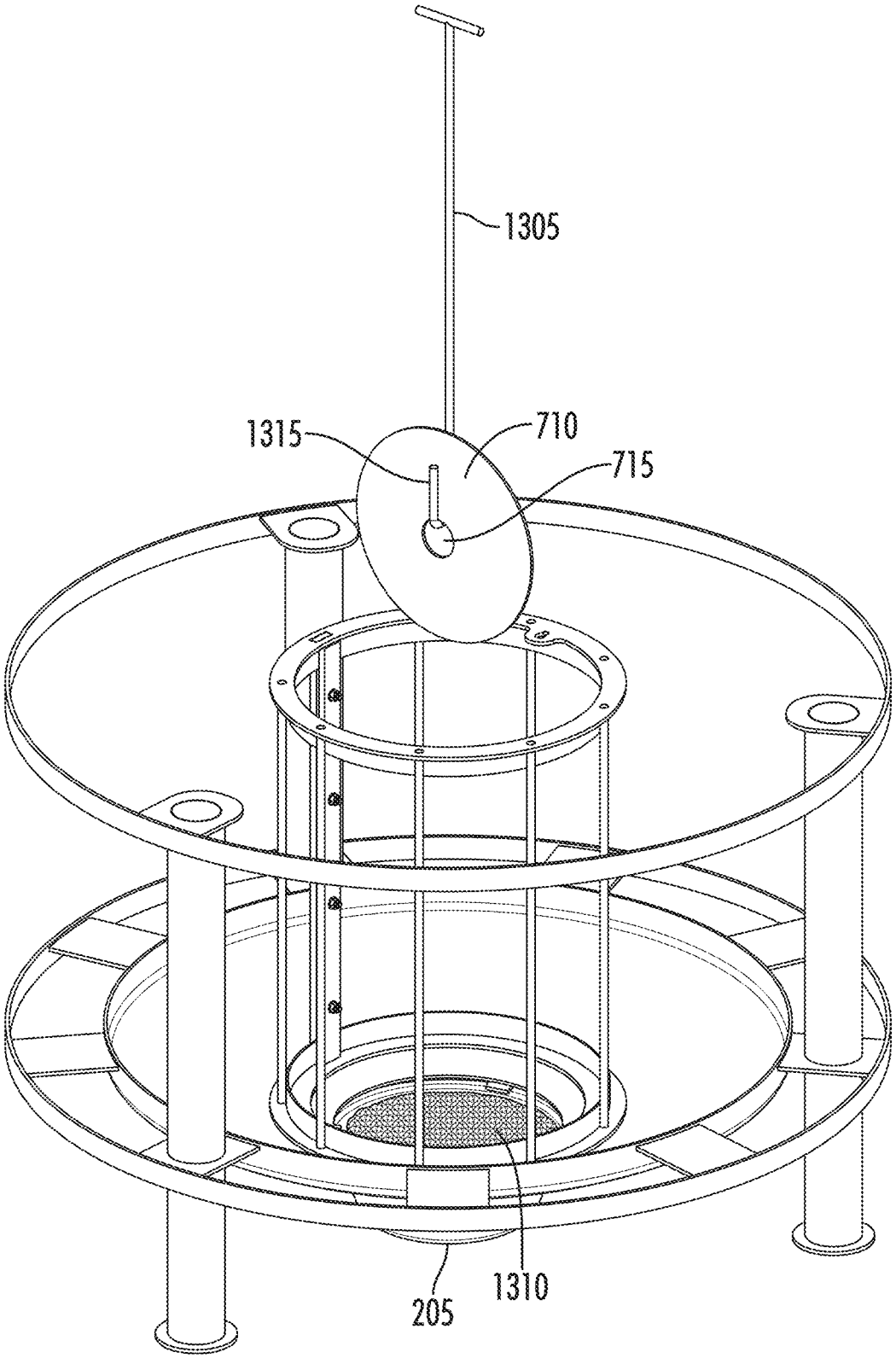
Figure 13E:
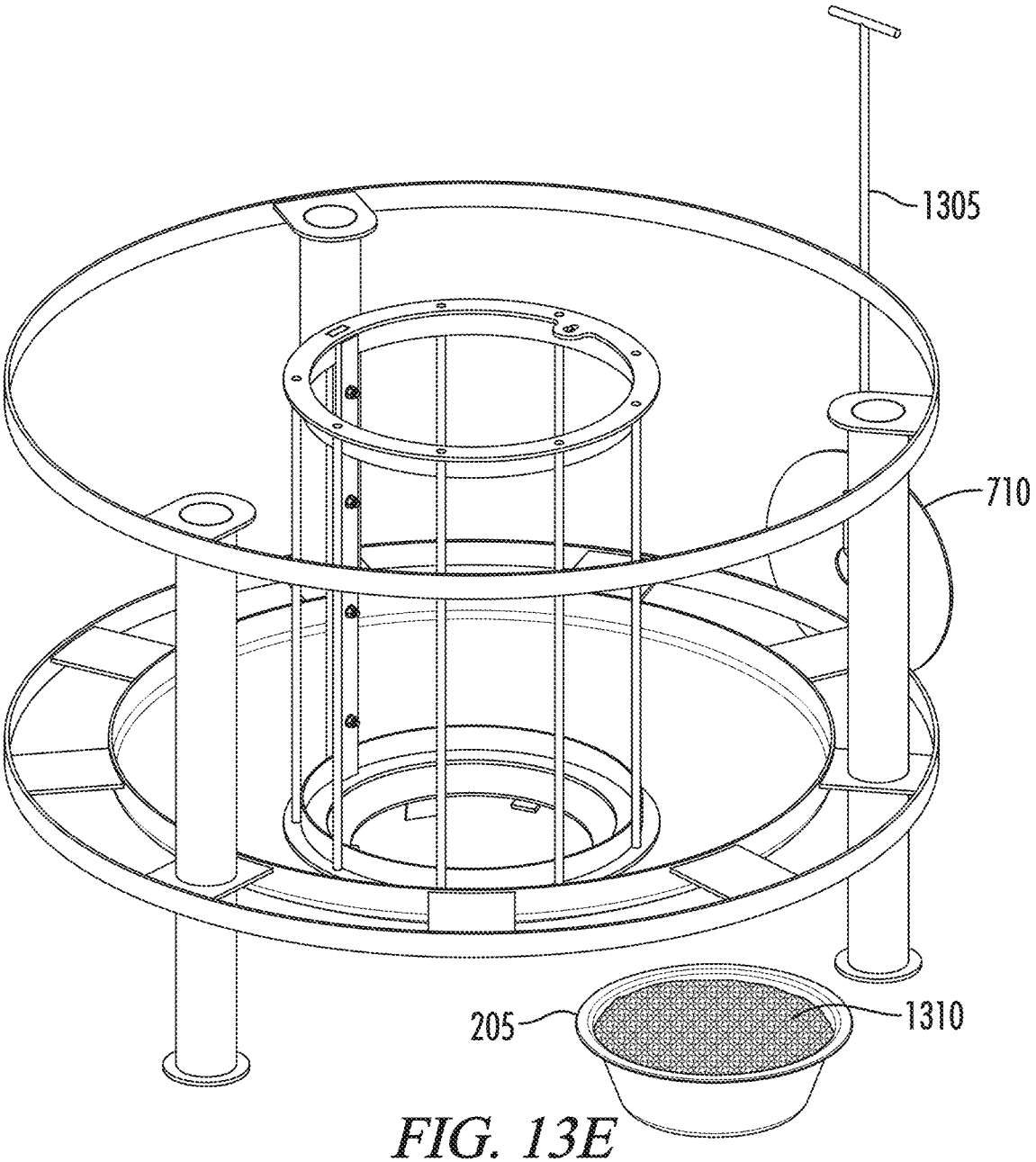

FIGS. 13A through 13E show fire pit 105 of FIG. 1 (with the reflector/spark screen 135 removed) and illustrate how a cover removal tool 1305 can be used to remove (or displace) the cover 710 from fire pit 105. After fire pit 105 is used, ashes and burned material 1310 will be located on top of cover 710 and directly above ash pan 205. In order to remove the ash and burned material 1310 from the burn cylinder 185, cover 710 is displaced or removed entirely with the use of the cover removal tool 1305 as described herein. As shown in FIG. 13A the bottom portion 1315 of the cover removal tool 1305 is inserted through the ash and burned material 1310 and through the cover opening 715. The bottom portion 1315 of the cover removal tool 1305 is lowered until the bottom portion 1315 of the cover removal tool 1305 is below the bottom of the cover 710 and the bottom portion 1315 of the cover removal tool 1305 is positioned inside the ash pan 205, if an ash pan 205 is attached to the bottom of the welded pipe cap base 115. FIG. 13B. Now the bottom portion 1315 of the cover removal tool 1305 is moved away from the center of the cover opening 715 and the cover removal tool 1305 is lifted up such that a portion of the bottom portion 1315 of the cover removal tool 1305 makes contact with the cover 710 and the cover 710 is dislodged from its position on the bottom of the welded pipe cap base 115 (FIG. 13C). At this point any ash or burned material 1310 that was located on the top of cover 710 should fall into the ash pan 205 when the ash pan 205 is attached, or positioned beneath, welded pipe cap base 115. If desired, the opening cover 710 can now be removed from the fire pit 105. See FIGS. 13D and 13E. Preferably, the bottom portion 1315 of the cover removal tool 1305 is curved.

Figure 14A:
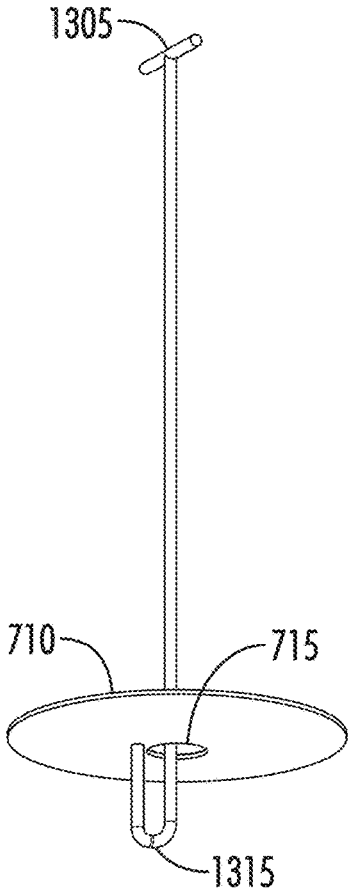
FIGS. 14A through 14C show the interaction between the cover removal tool 1305 and the cover outside of fire pit.
Figure 14B:
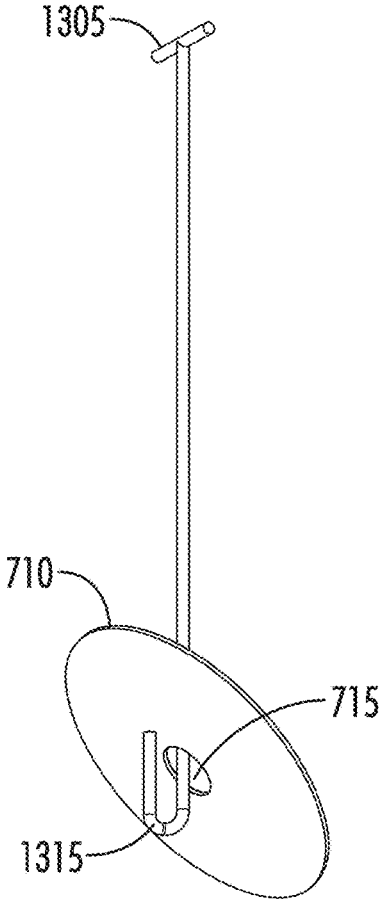
Figure 14C:
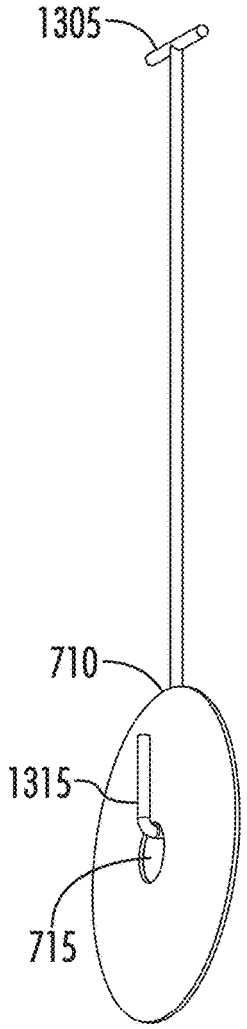

FIGS. 14A through 14C show the interaction between the cover removal tool 1305 and the cover 710 outside of fire pit 105. In FIG. 14A, bottom portion 1315 of the cover removal tool 1305 is inserted through the cover opening 715 and moved such that a bottom portion 1315 of the cover removal tool 1305 is below the cover 710. As shown in FIG. 14B, the cover removal tool 1305 is lifted at this point to dislodge the cover 710 from the opening in the welded pipe cap base (not shown). Once the cover 710 is dislodged, it can be removed from the fire pit.

Figure 15A:
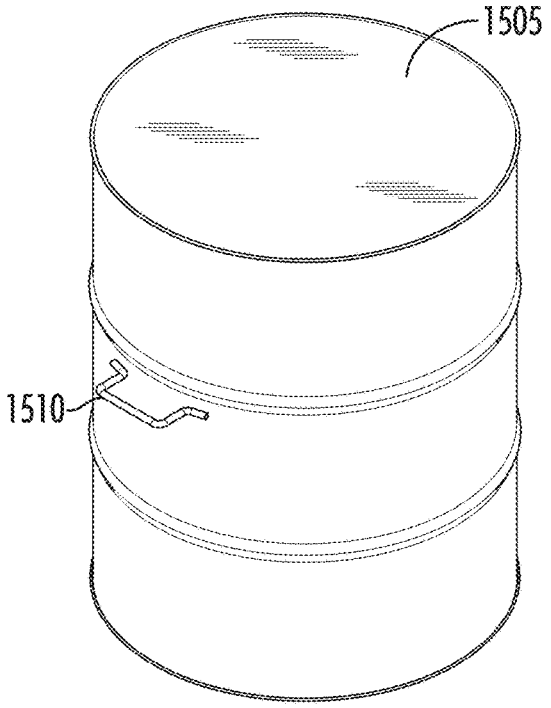
FIGS. 15A-15C show a top perspective view, a bottom perspective view, and a side view of a fire extinguishing barrel for use with the fire pit.
Figure 15B:
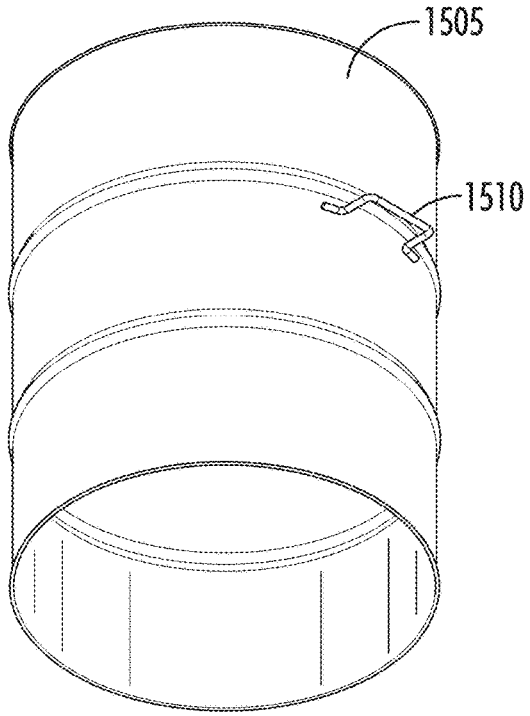
Figure 15C:
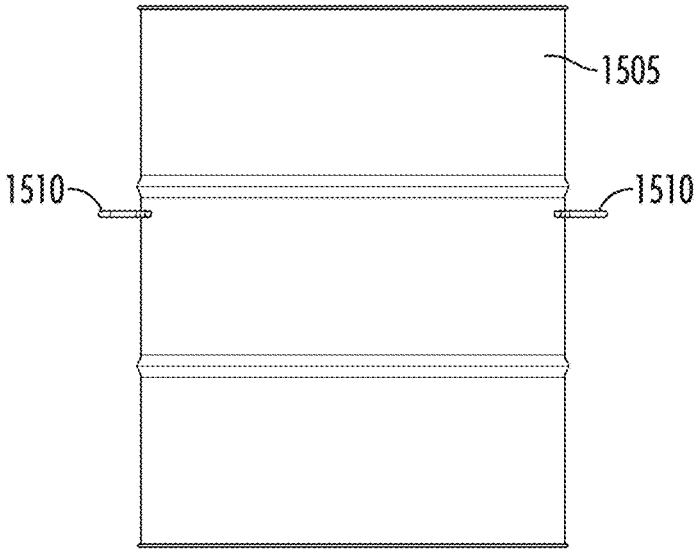

FIGS. 15A-15C show a top perspective view, a bottom perspective view, and a side view of a fire extinguishing barrel 1505 for use with fire pit 105. In use, the fire extinguishing barrel 1505 is placed over the top of the burner assembly 185 of fire pit 105 to extinguish any fire burning within fire pit 105. Fire extinguishing barrel 1505 may be fitted with one or more handles 1510 to assist in the placement and removal of the fire extinguishing barrel 1505 over fire pit 105.

Figure 16:
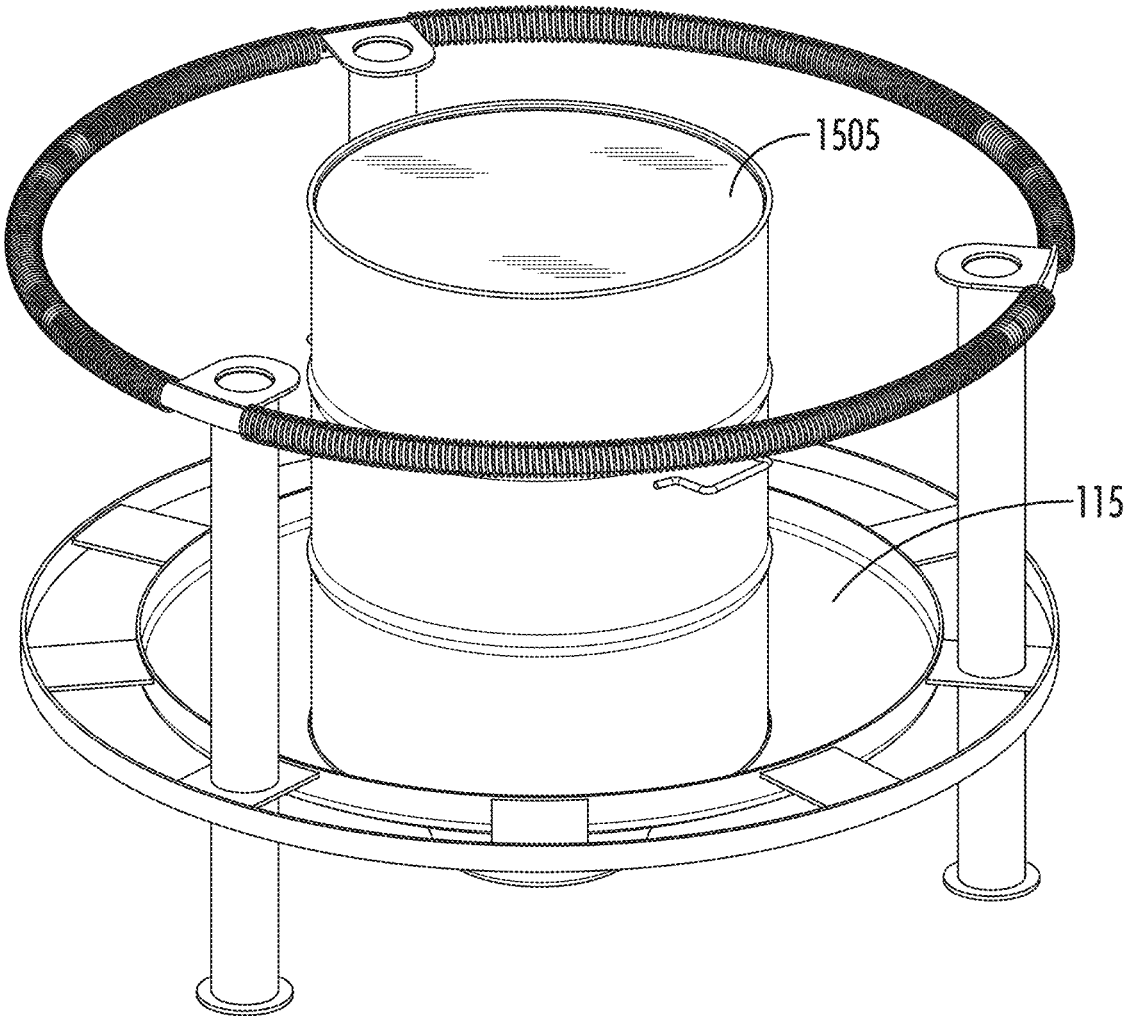
FIG. 16 shows how fire extinguishing barrel is positioned on fire pit 105 to extinguish the fire.

FIG. 16 shows how fire extinguishing barrel 1505 is positioned on fire pit 105 to extinguish the fire.

Figure 17:
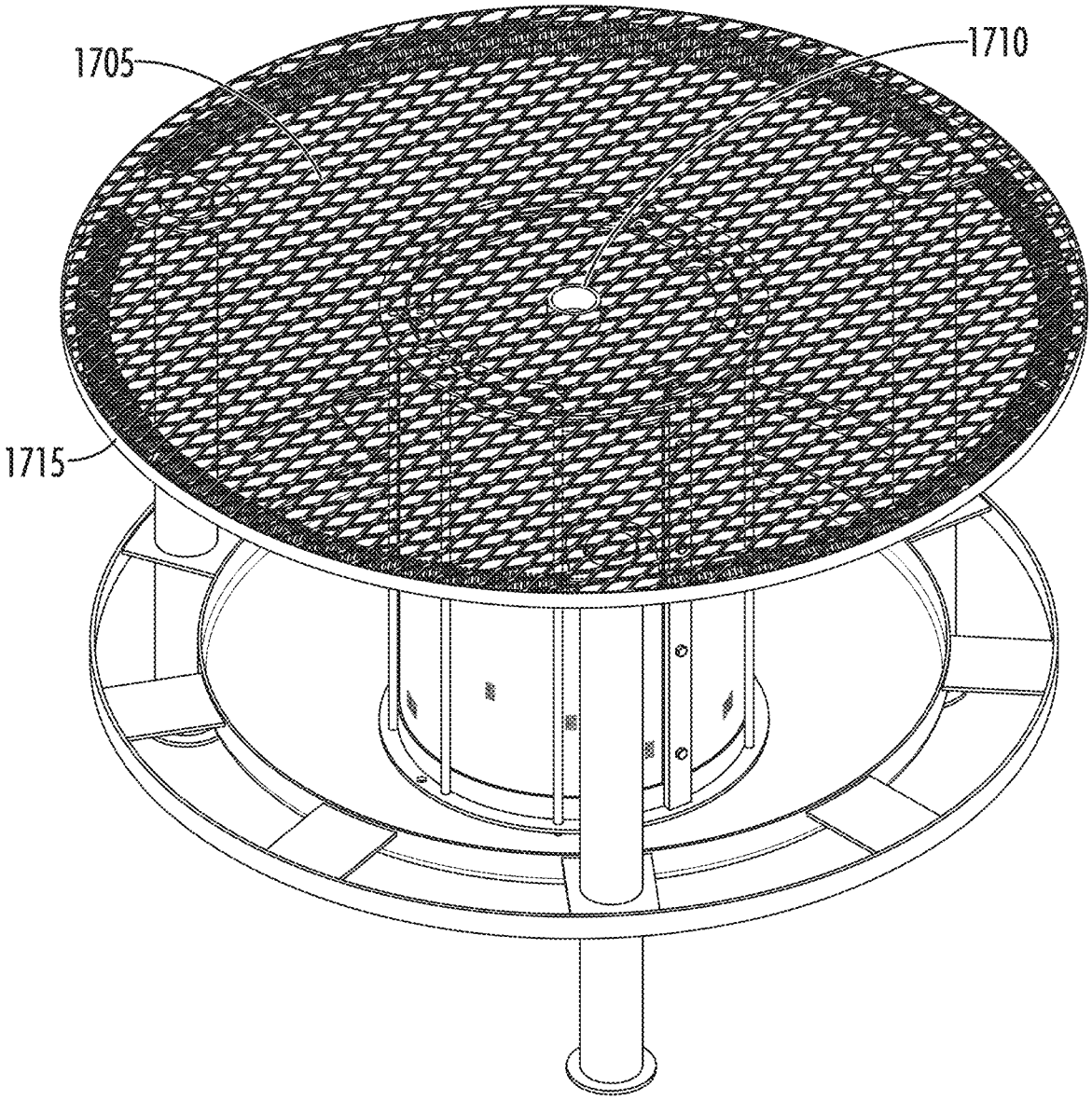
FIG. 17 is a top perspective view of an embodiment of the fire pit with an optional metal tabletop.

FIG. 17 is a top perspective view of another embodiment of the fire pit of the present invention, where this embodiment includes an optional metal tabletop 1705. The optional metal tabletop 1705 preferable fits over the upper rail 150 and the coil spring upper rail bumper 155. Preferably, the damper lid 160 is removed before the optional metal tabletop 1705 is positioned over the top of the fire pit 105. The optional metal tabletop 1705 may also include an umbrella shaft ring 1710. When the optional metal tabletop 1705 includes an umbrella shaft ring 1710, the umbrella shaft ring 1710 would preferably be aligned with the cover opening 715 in the cover 710. In this configuration, the vertical shaft of an umbrella positioned inside the umbrella shaft ring 1710 would travel through either the opening 705 or the cover opening 715 and, preferably into an umbrella base. A tabletop angle band 1715 may be included around the circumference of the optional metal tabletop 1705.

Figure 18:
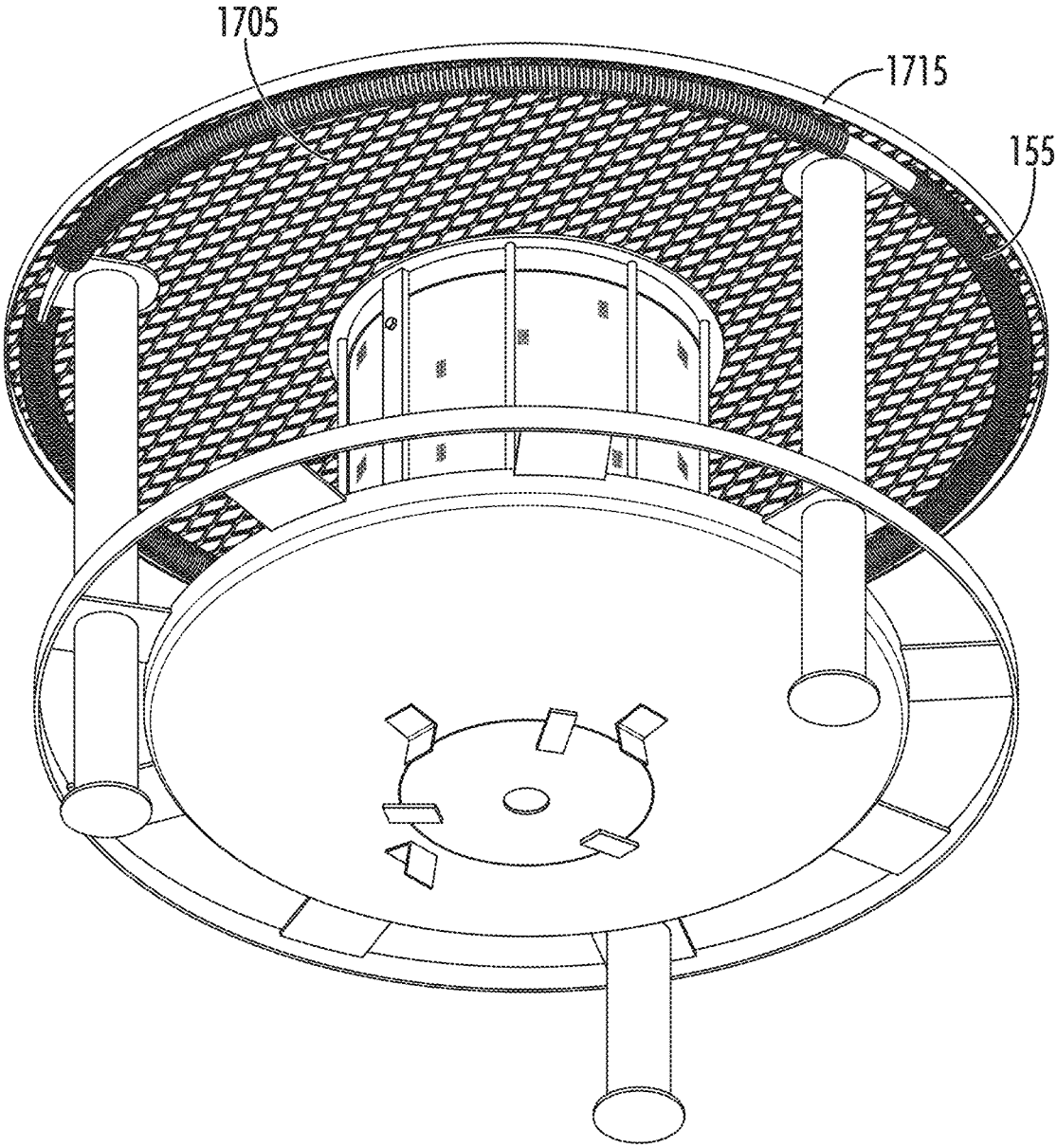
FIG. 18 is a bottom perspective view of the embodiment of the fire pit of FIG. 17.

FIG. 18 is a bottom perspective view of the embodiment of the fire pit shown in FIG. 17 specifically showing how the optional metal tabletop 1705 fits over the upper rail 150 and the coil spring upper rail bumper 155. As shown, the metal tabletop 1705 preferably rests directly on the coil spring upper rail bumper 155, but a cushioning device or other intermediary object could be placed between the top of the coil spring upper rail bumper 155 and the bottom of the optional metal tabletop 1705 to protect both the coil spring upper rail bumper 155 and the optional metal tabletop 1705. FIG. 18 also shows a different attachment configuration between the ash pan 205 and the bottom of the welded pipe cap base 115.

Figure 19:
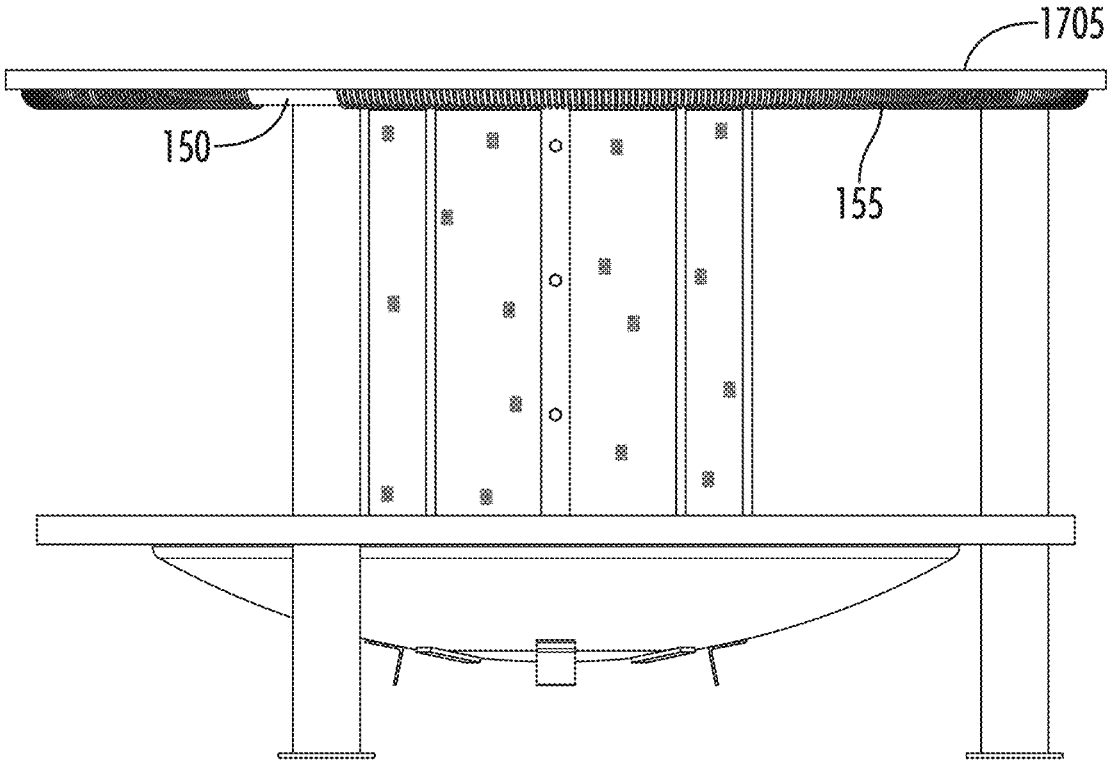
FIG. 19 is side view of the embodiment of the fire pit of FIG. 17.

FIG. 19 is side view of the embodiment of the fire pit shown in FIG. 17 specifically showing how the optional metal tabletop 1705 can be positioned overtop of the coil spring upper rail bumper 155 and the upper rail 150 located inside the coil spring upper rail bumper 155. As shown in FIG. 19, the depth of the optional metal tabletop 1705 may be less than the width of the coil spring upper rail bumper 155.

Figure 20:
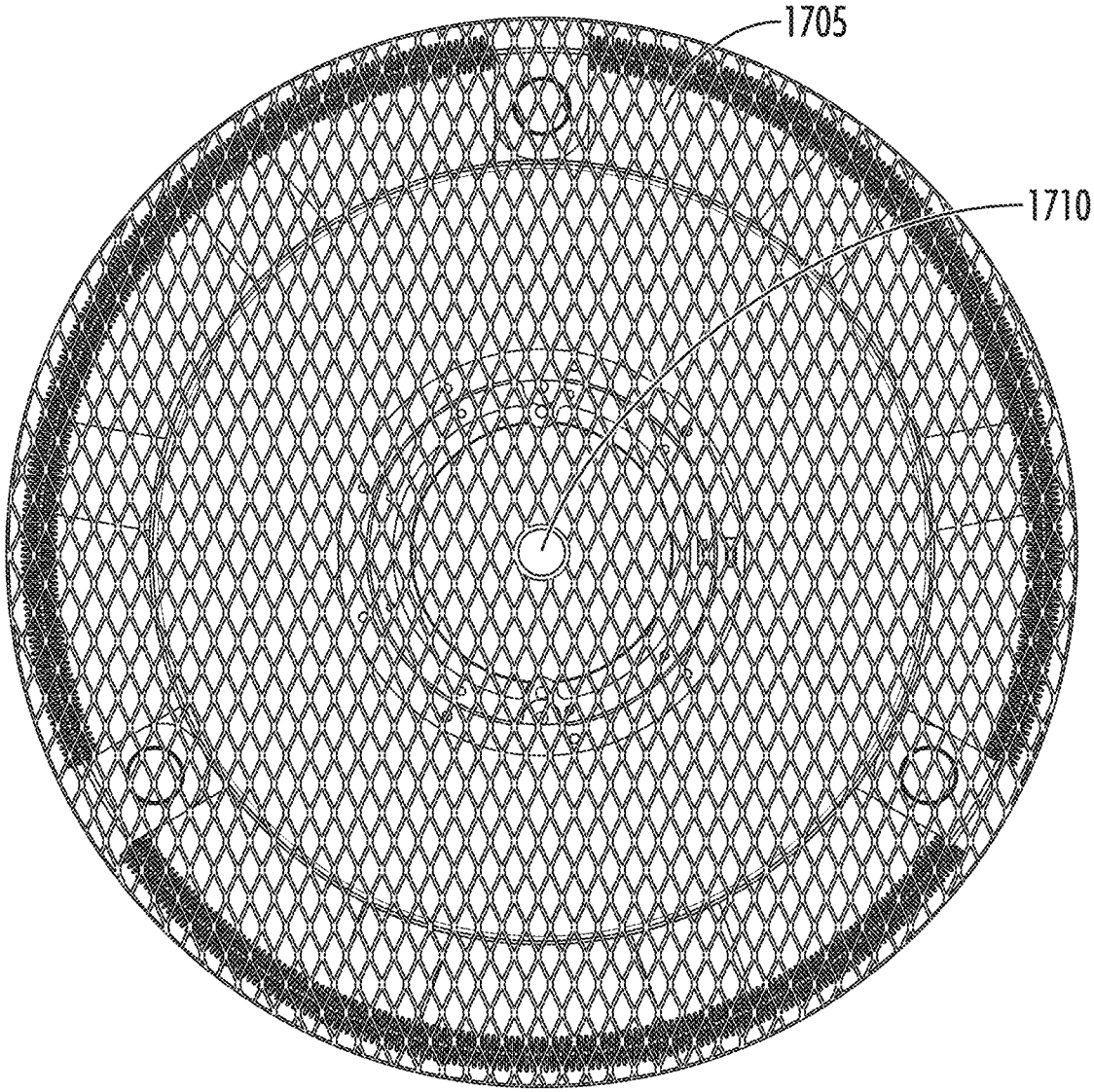
FIG. 20 is top view of the embodiment of the fire pit of FIG. 17.

FIG. 20 is top view of the embodiment of the fire pit shown in FIG. 17 showing how the optional metal tabletop fits over the top of fire pit 105. FIG. 20 also shows how the umbrella shaft ring 1710 could be centered over the cover opening 715.

Figure 21:
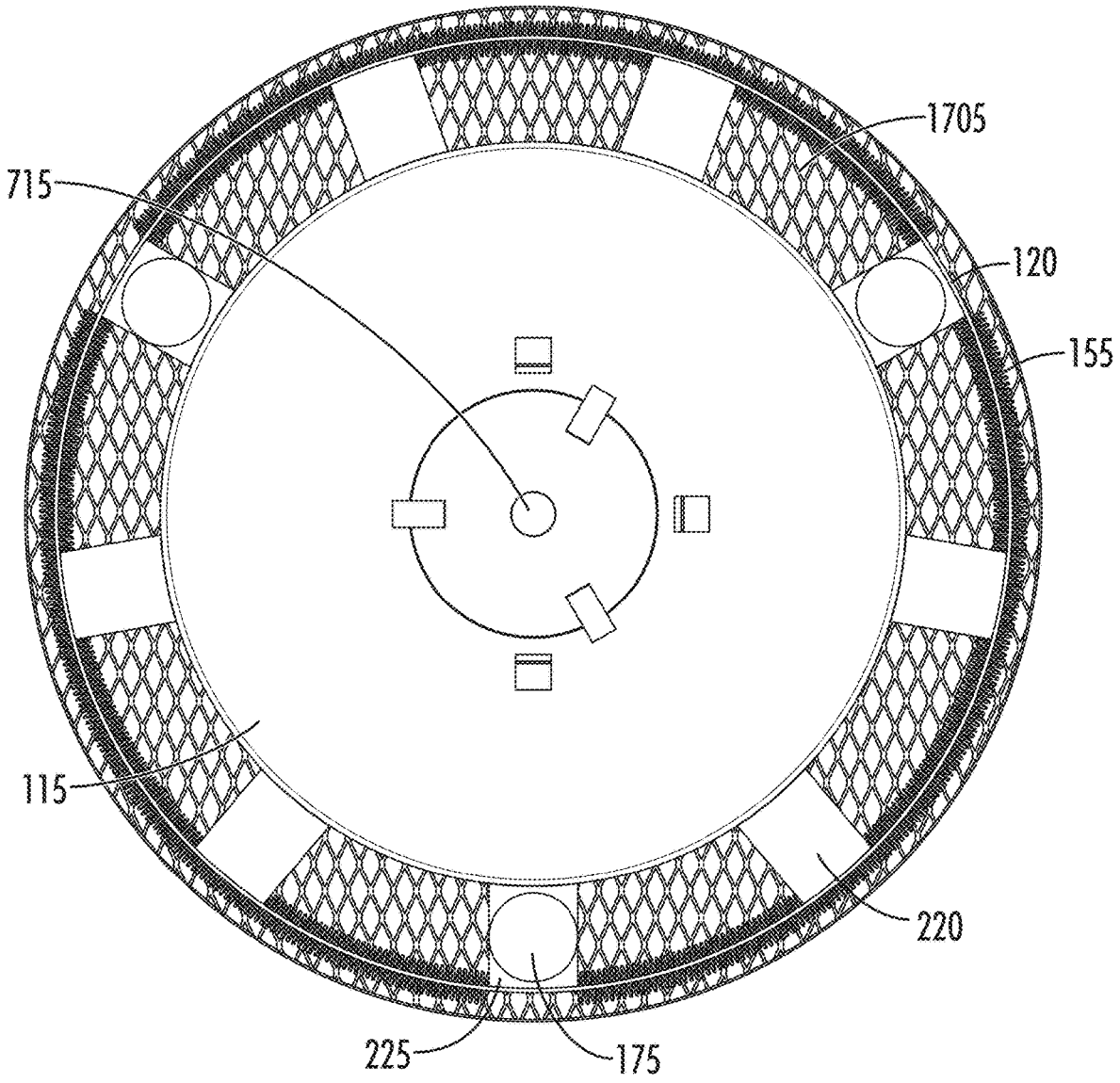
FIG. 21 is bottom view of the embodiment of the fire pit of FIG. 17 with the ash pan removed.

FIG. 21 is bottom view of the embodiment of the fire pit shown in FIG. 17 with the ash pan 205 removed showing how the optional metal tabletop 1705 is seen from the bottom of the fire pit 105.

Figure 22:
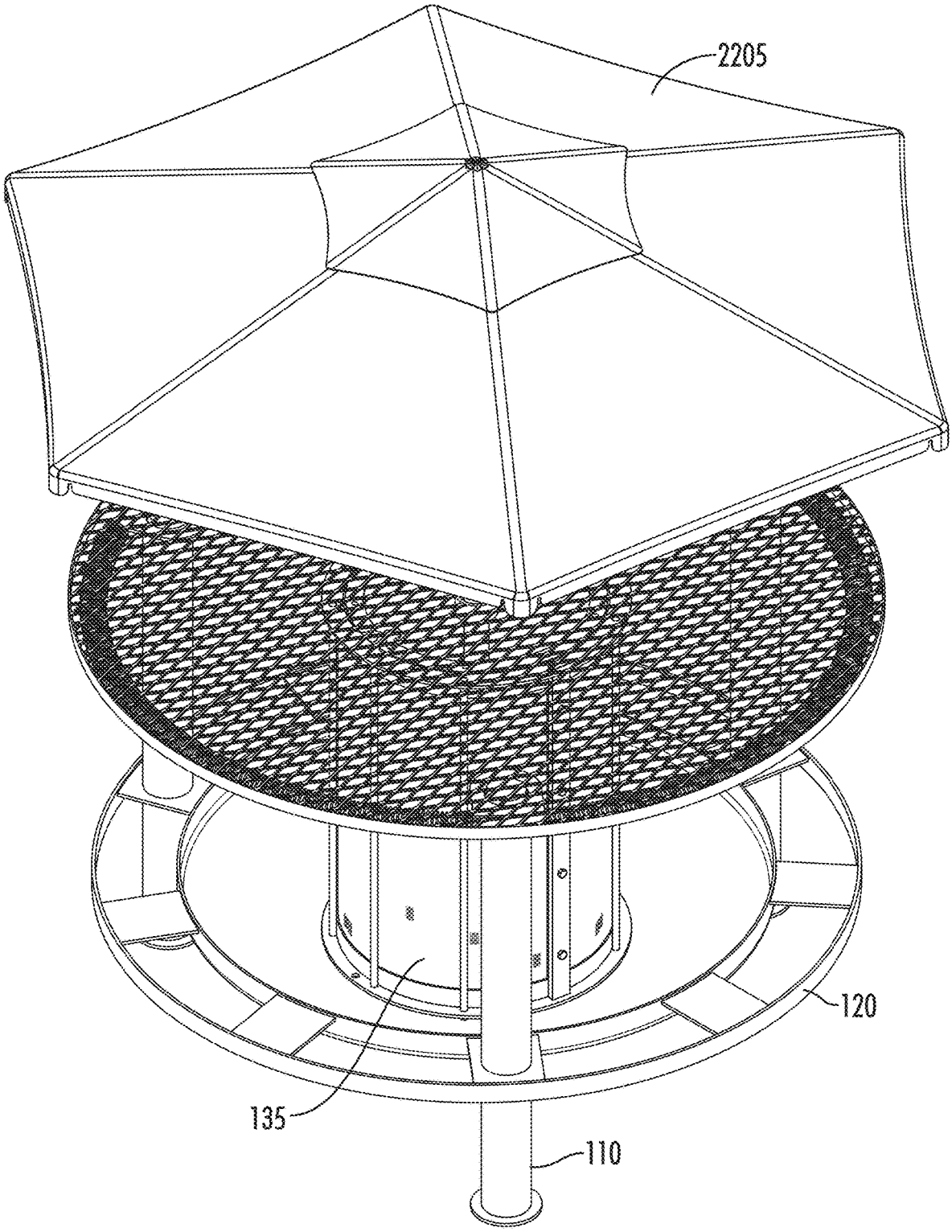
FIG. 22 is top perspective view of the embodiment of the fire pit of FIG. 17 with an umbrella in place.

FIG. 22 is a top perspective view of the embodiment of the fire pit shown in FIG. 17 with an umbrella 2205 in place. The diameter of the umbrella 2205 could be the same size as the diameter of the upper rail 150. Alternatively, the diameter of the umbrella 2205 could be greater than the diameter of the upper rail 150 to provide additional shade around the perimeter of fire pit 105.

Figure 23:
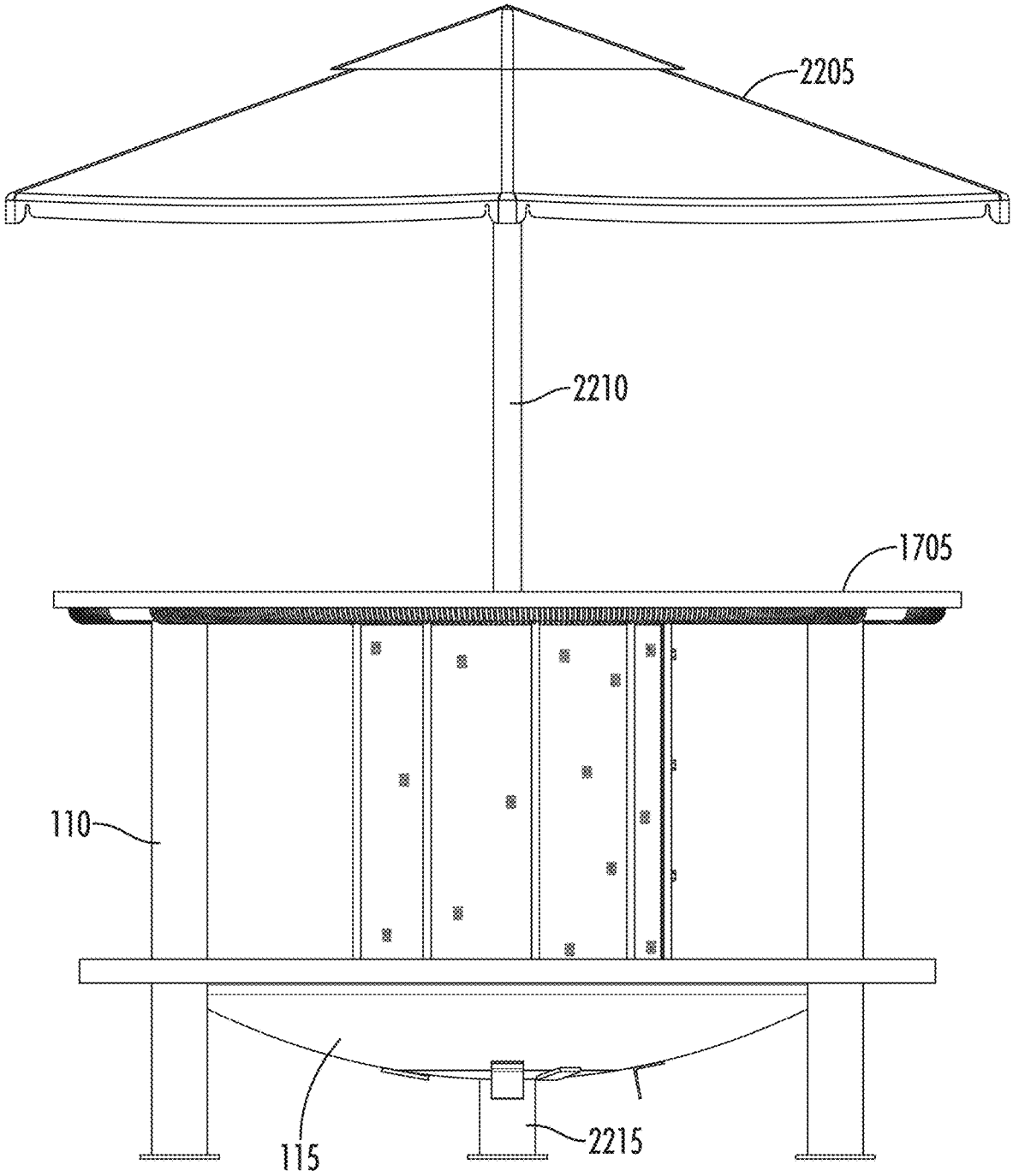
FIG. 23 is side view of the embodiment of the fire pit of FIG. 22.

FIG. 23 is side view of the fire pit of FIG. 22 with the optional expanded metal umbrella tabletop and an umbrella in place. As shown in FIG. 23, the shaft of the umbrella 2210 passes through the umbrella shaft ring 1710 of the metal tabletop 1705, through the opening in the welded pipe cap base 705 and the end of the umbrella shaft may rest in an umbrella stand 2215.

Figure 24:
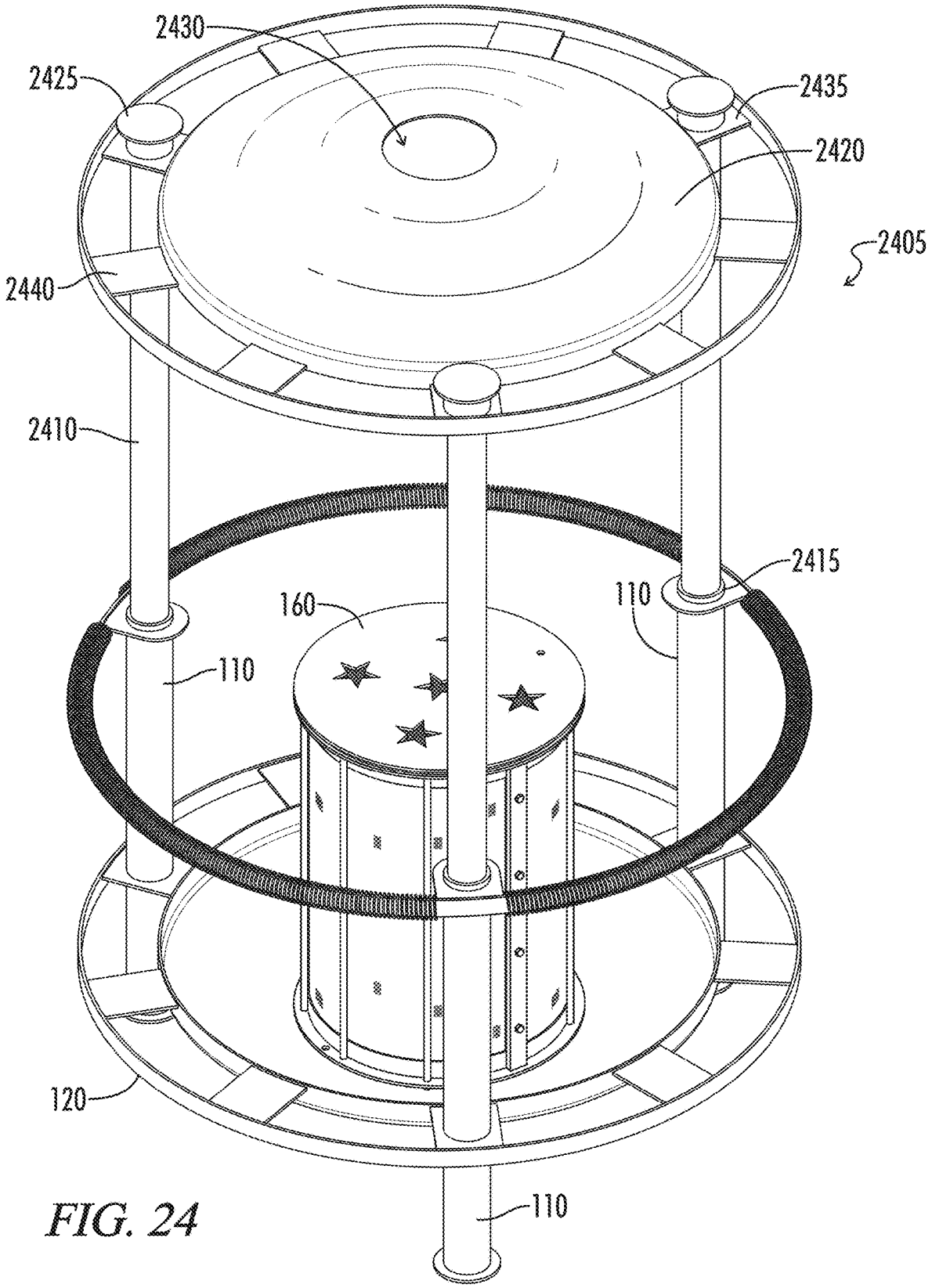
FIG. 24 is a top perspective view of an embodiment of the fire pit which includes an exhaust attachment.

FIG. 24 is a top perspective view of an embodiment of the fire pit which includes an exhaust attachment 2405. This embodiment is envisioned to be used in a gazebo or inside a house. To configure the fire pit 105 for use with an exhaust attachment 2405, the leg cap inserts 170 (not shown) are removed from the tops of legs 110, and the ends of the exhaust vent legs 2410 are inserted into legs 110. One of ordinary skill in the art would appreciate that the exhaust vent legs 2410 may also fit around the outside of the tops of legs 110. In a preferred embodiment, the diameter of the legs 110 is 3 inches and the diameter of the pipe that fits inside the legs 110 is 2.50 inches. An exhaust vent leg ring 2415 may also be used to limit the portion of the exhaust vent leg 2410 that is inserted into legs 110. Once the exhaust vent legs 2410 are positioned, an exhaust cover 2420 is attached to the top of each of the exhaust vent legs 2410. Exhaust vent leg caps 2425 may also be inserted into the end of the exhaust vent legs 2410. The exhaust cover 2420 would also include an exhaust vent 2430. An exhaust vent pipe collar (not shown) may be attached to the exhaust vent 2430 to ensure that any smoke and fumes are directed outside the gazebo or house. The exhaust cover 2420 may also include exhaust vent leg spokes 2435 and/or exhaust vent spokes 2440.

Figure 25:
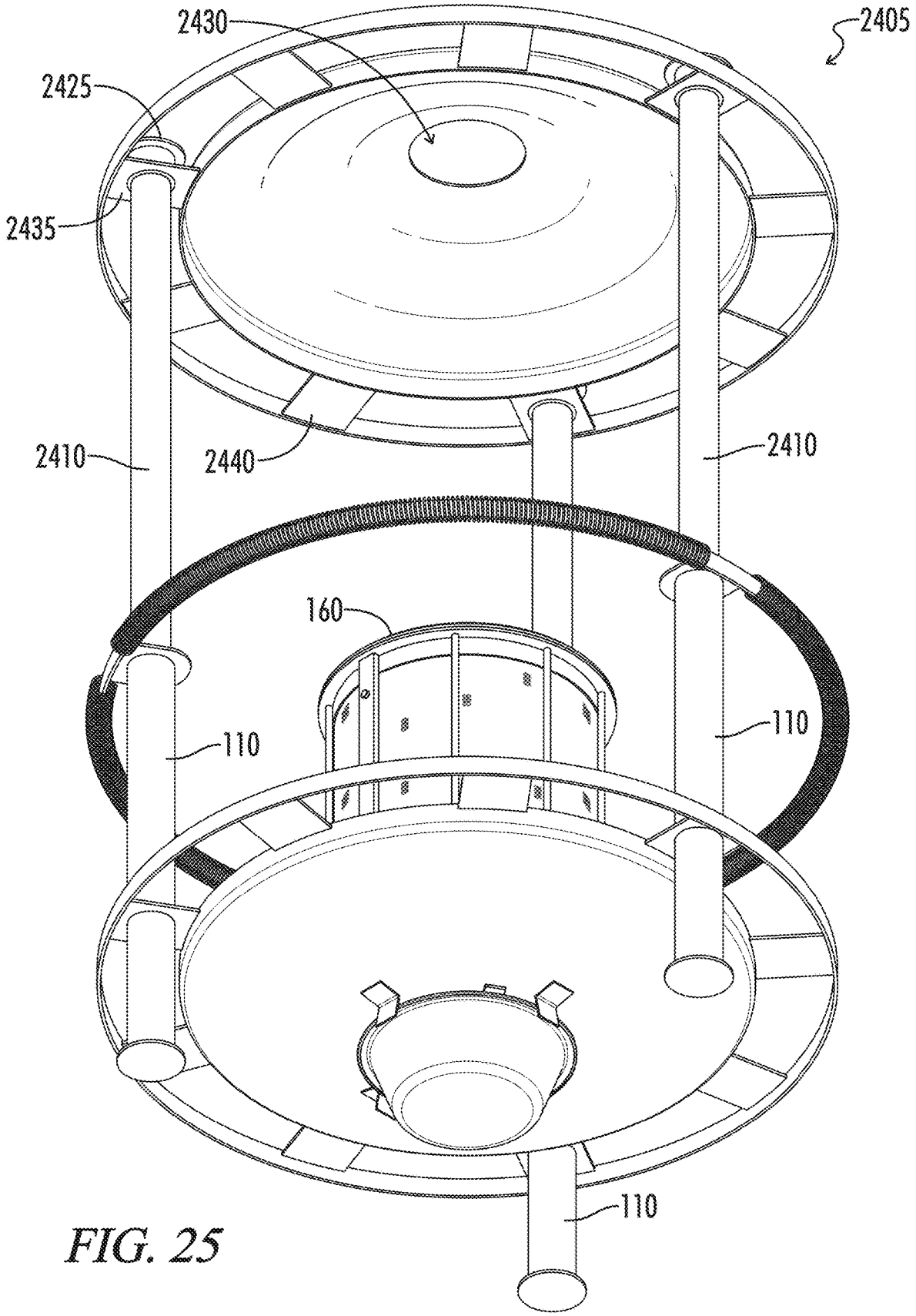
FIG. 25 is a bottom perspective view of the embodiment of the fire pit of FIG. 24.

FIG. 25 is a bottom perspective view of the embodiment of the fire pit of FIG. 24 which includes the exhaust attachment 2405.

Figure 26:
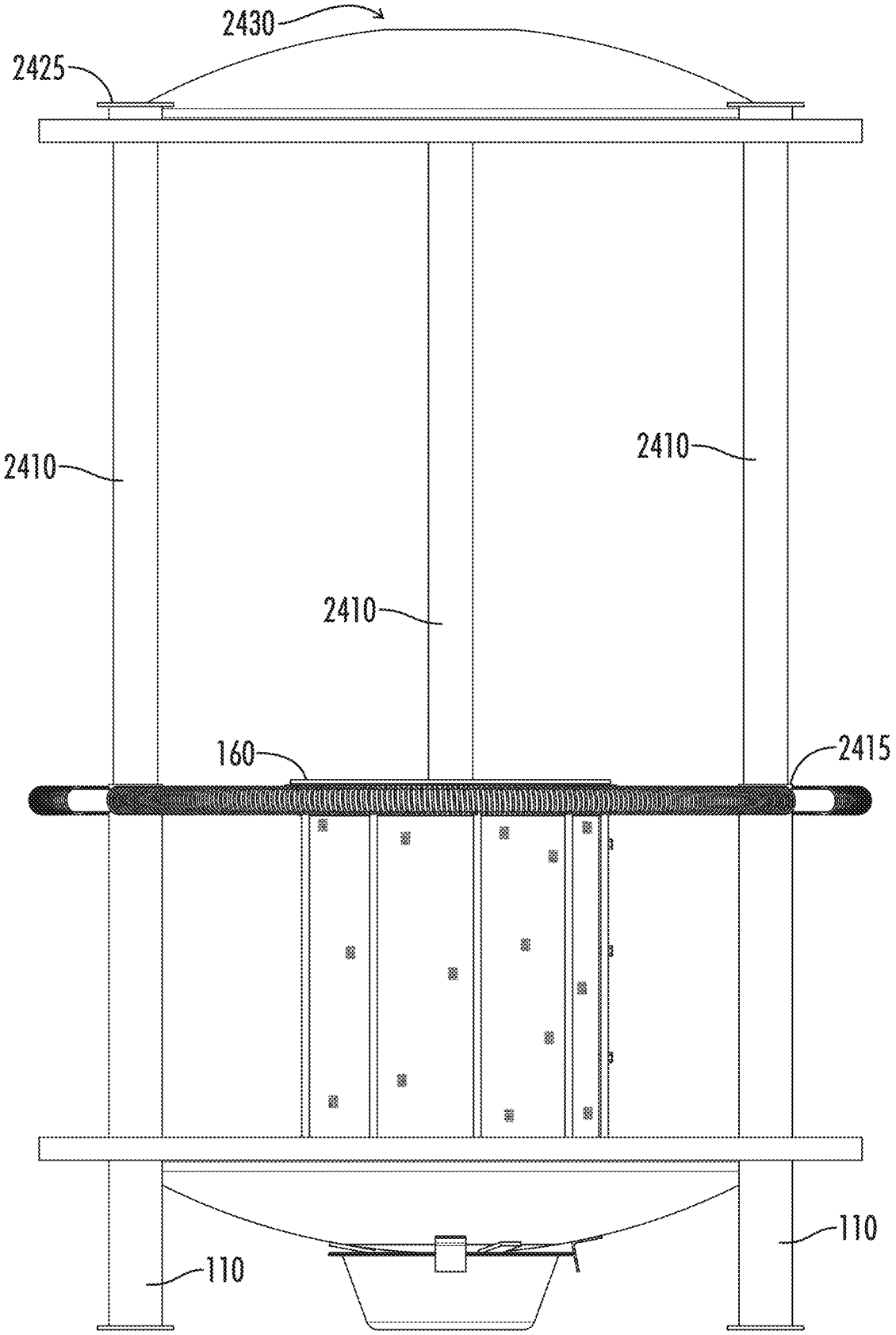
FIG. 26 is a side view of the embodiment of the fire pit of FIG. 24.

FIG. 26 is a side view of the embodiment of the fire pit of FIG. 24 with includes an exhaust attachment 2405.

Figure 27:
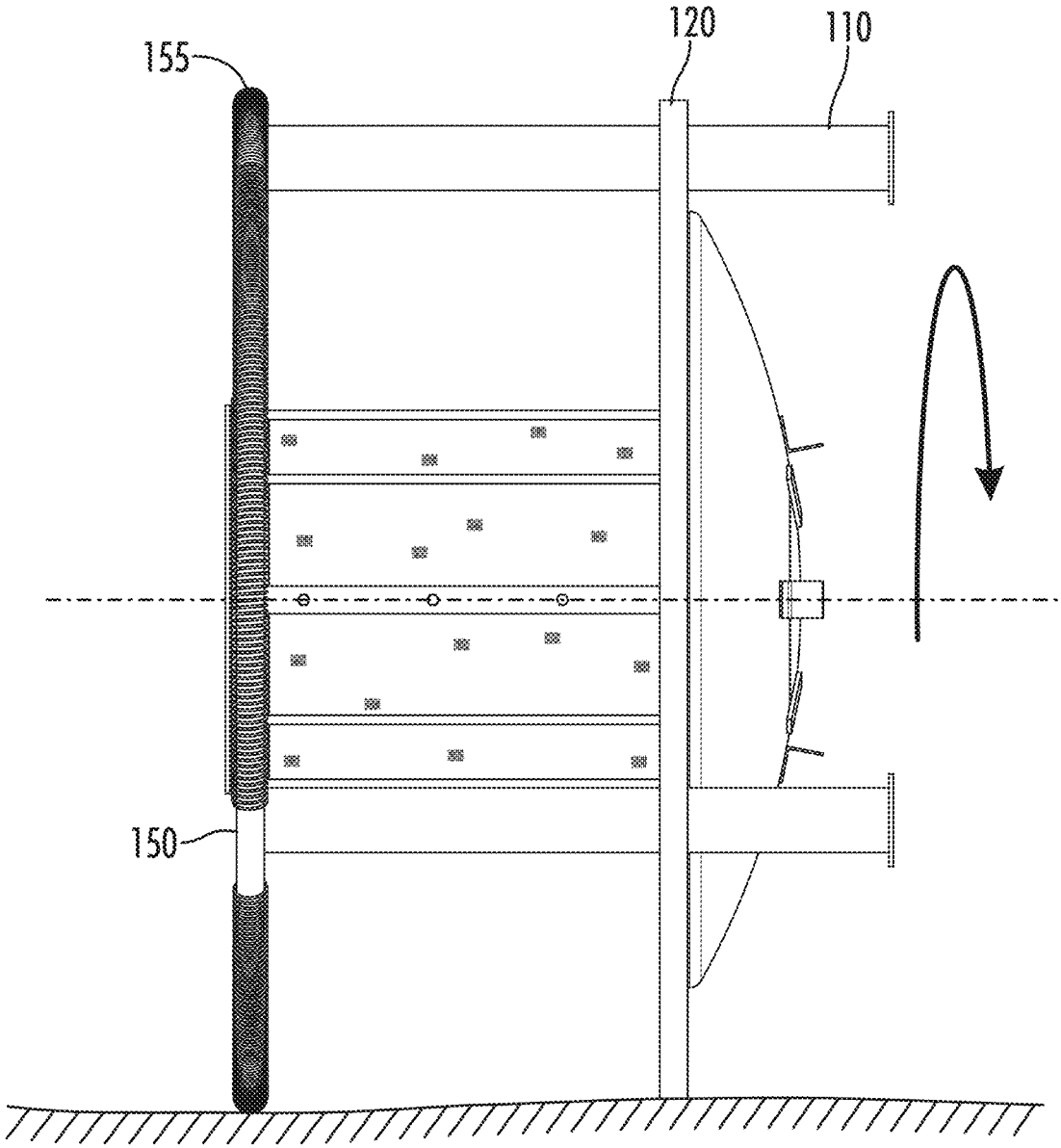
FIG. 27 is the fire pit of FIG. 1 positioned on its side to be moved from a first position to a second position.

FIG. 27 is the fire pit 105 of FIG. 1 on its side to be moved from a first position to a second position. As shown in FIG. 27, fire pit 105 may be laid on its side (preferably after the damper lid has been removed) such that fire pit 105 is resting on the upper rail 150 and/or the coil spring upper rail bumper 155, and lower rail 120. Once fire pit 105 is positioned on its side, it can be rolled from one location to the next.

Figure 28:
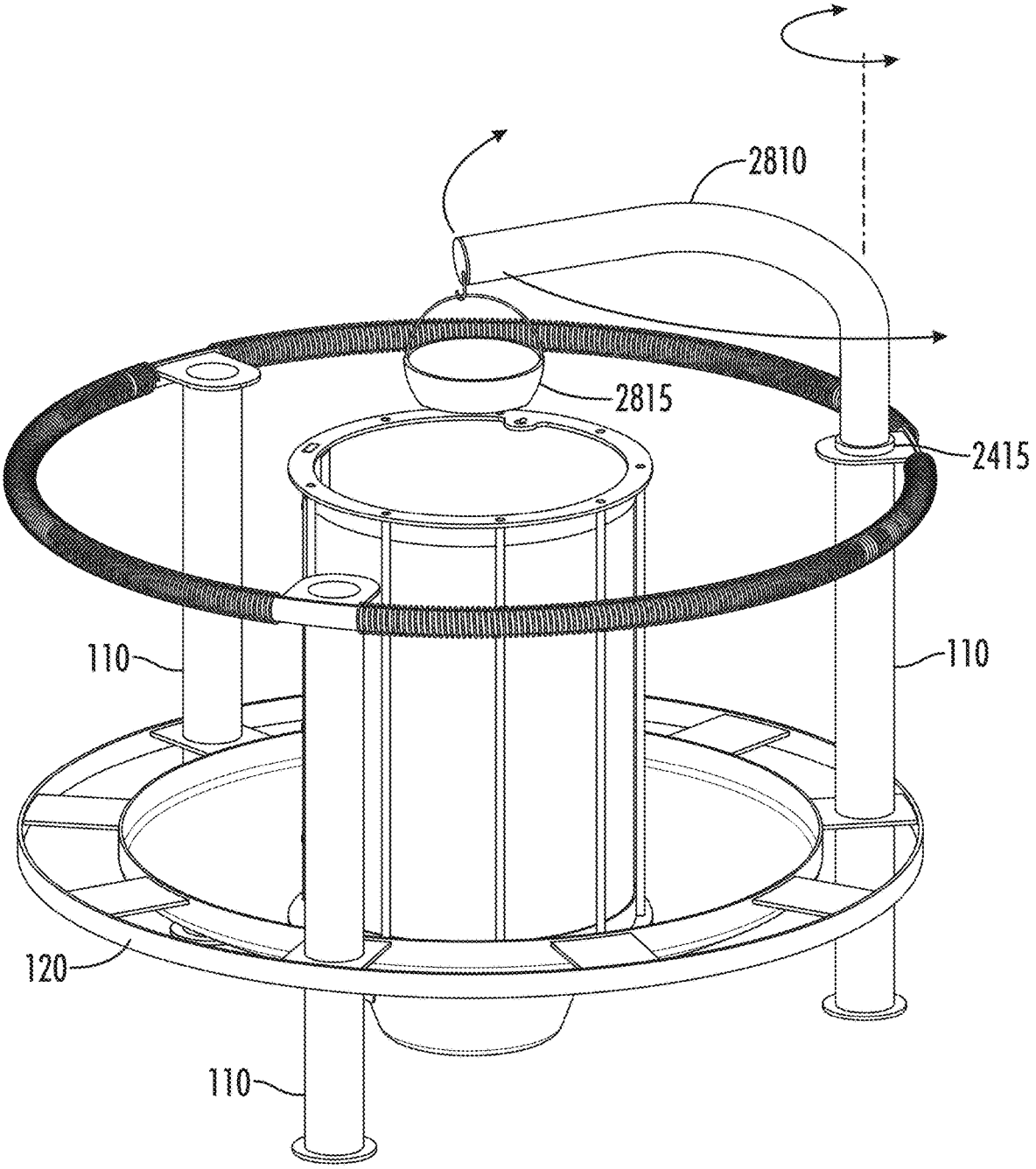
FIG. 28 illustrates how cooking attachments can be used with the fire pit of FIG. 1.

FIG. 28 illustrates how cooking attachments can be used with the fire pit of FIG. 1. To configure fire pit 105 for use with cooking attachments, at least one of the leg cap inserts 170 is removed. The ends of a cooking vent leg 2810 is inserted into one of the legs 110. One of ordinary skill in the art would appreciate that the cooking vent leg 2810 may also fit around the outside of the top of the leg 110. An leg ring 2415 may also be used to limit the portion of the cooking vent leg 2810 that is inserted into legs 110. Once the cooking vent leg 2810 is in position, a pot or other cooking utensil 2815 is connected to the cooking vent leg 2180 and used for cooking over the fire pit 105. Preferably, the cooking vent leg may be rotated such that the cooking utensil can be positioned at a location other than over the fire pit 105 for stirring or other cooking actions.

Unless defined otherwise, all technical terms used herein have the same meaning as commonly understood by one of ordinary skill in the art to which this invention belongs. Any methods and materials similar or equivalent to those described herein also can be used in the practice or testing of the present disclosure While the present disclosure has been described with reference to the specific embodiments thereof, it should be understood by those skilled in the art that various changes may be made and equivalents may be substituted without departing from the true spirit and scope of the invention. In addition, many modifications may be made to adopt a particular situation, material, composition of matter, process, process step or steps, to the objective spirit and scope of the present disclosure. All such modifications are intended to be within the scope of the claims appended hereto.

What is claimed is:

1. A suspended burn cylinder comprising:

a reflector/spark screen, a reflector/spark connector plate wherein said reflector/spark connector plate attaches a first portion of said reflector/spark screen to a second portion of said reflector/spark screen, a frame flange wherein said reflector/spark connector plate is attached to said frame flange, a spark screen keeper wherein said spark screen keeper is attached to said frame flange and wherein a portion of said reflector/spark connector is located inside said spark screen keeper, a welded pipe cap base, at least one frame flange to base connector rod wherein said frame flange to base connector rod is attached to said frame flange and to said welded pipe cap base and is configured to maintain a gap between said frame flange and said welded pipe cap base; and a damper lid wherein said damper lid is situated above the at least one frame flange and said damper lid is connected to at least one frame flange and is rotatable.

2. The suspended burn cylinder of claim 1 wherein the gap between said frame flange and said welded pipe case base is between 0.5 inches and 2.0 inches.

3. The suspended burn cylinder of claim 1 wherein the damper lid is removable.

4. The suspended burn cylinder of claim 1 wherein the damper lid includes at least one opening, and wherein the at least one opening comprises a mesh.

5. The suspended burn cylinder of claim 1 wherein the surface area of the mesh is no more than 50 percent open space.

* * * * *